US005483327A

United States Patent [19]

Taya et al.

[11] Patent Number: 5,483,327

[45] Date of Patent: Jan. 9, 1996

[54] TONER FOR DEVELOPING ELECTROSTATIC IMAGE, FORMING APPARATUS AND PROCESS CARTRIDGE

[75] Inventors: Masaaki Taya, Kawasaki; Takaaki Kohtaki, Yokohama; Makoto Unno, Tokyo; Tadashi Doujo, Ebina, all of Japan

[73] Assignee: Canon Kabushiki Kaisha, Tokyo, Japan

[21] Appl. No.: 398,791

[22] Filed: Mar. 6, 1995

Related U.S. Application Data

[62] Division of Ser. No. 228,269, Apr. 15, 1994, Pat. No. 5,439,770.

[30] Foreign Application Priority Data

Apr. 20, 1993 [JP] Japan ..... 5-093181

[51] Int. Cl.[6] ..... G03G 15/06

[52] U.S. Cl. ..... 355/245; 118/653; 430/110; 430/111

[58] Field of Search ..... 355/200, 210, 355/211, 245; 118/653, 656; 430/105, 107, 109–111

[56] References Cited

U.S. PATENT DOCUMENTS 2,221,776 11/1940 Carlson ..... 430/48
2,297,691 10/1942 Carlson ..... 430/55

(List continued on next page.)

FOREIGN PATENT DOCUMENTS 60-170864 9/1985 Japan .
61-155464 7/1986 Japan .

(List continued on next page.)

*Primary Examiner*—William J. Royer
*Attorney, Agent, or Firm*—Fitzpatrick, Cella, Harper & Scinto

[57] ABSTRACT

An image forming apparatus and a process cartridge includes a toner for developing an electrostatic image that is constituted by at least a binder resin and a charge control agent. The binder resin has an acid value of 5–50. The charge control agent includes an iron complex represented by the following formula:

wherein $X_1$ and $X_2$ independently denote hydrogen atom, lower alkyl group, lower alkoxy group, nitro group or halogen atom; m and m' denote an integer of 1–3; $R_1$ and $R_3$ independently denote hydrogen atom, $C_{1-18}$ alkyl or alkenyl, sufonamide, mesyl, sulfonic acid group, carboxy ester group, hydroxy, $C_{1-18}$ alkoxy, acetylamino, benzoylamino or halogen atom; n and n' denote an integer of 1–3; $R_2$ and $R_4$ denote hydrogen atom or nitro group; and $A^+$denotes hydrogen ion, sodium ion, potassium ion or ammonium ion. The toner has a weight-average particle size ($D_4$) of 4–9 μm and including toner particles having a particle size of 5 μm or smaller at 3–90% by number, toner particles having a particle size of 6.35–10.08 μm at 1–80% by number and toner particles having a particle size of 12.7 μm or larger at a percentage by volume of at most 2.0%, wherein the toner particles having a particle size of 5.0 μm or smaller are contained at N % by number and at V % by volume satisfying a relationship:

$$N/V=0.05N+k,$$

wherein k is a positive number in the range of 3.0–7.5.

48 Claims, 3 Drawing Sheets

U.S. PATENT DOCUMENTS

| | | | |
|---|---|---|---|
| 2,618,552 | 11/1952 | Wise | 430/121 |
| 2,874,063 | 2/1959 | Greig | 430/106.6 |
| 3,666,363 | 5/1972 | Tanaka et al. | 430/55 |
| 3,909,258 | 9/1975 | Kotz | 430/122 |
| 4,071,361 | 1/1978 | Marushima | 430/54 |
| 4,540,268 | 9/1985 | Toyono et al. | 355/210 |
| 4,623,606 | 11/1986 | Ciccarelli | 430/110 |
| 4,639,119 | 1/1987 | Isaka | 355/260 X |
| 4,990,426 | 2/1991 | Diaz et al. | 430/110 |
| 5,169,738 | 12/1992 | Tanikawa et al. | 430/106.6 |
| 5,223,893 | 6/1993 | Ikemoto et al. | 355/200 |
| 5,250,382 | 10/1993 | Shimojo et al. | 430/109 |

FOREIGN PATENT DOCUMENTS

| | | |
|---|---|---|
| 62-177561 | 8/1987 | Japan . |
| 1-306862 | 12/1989 | Japan . |
| 2-153362 | 6/1990 | Japan . |
| 3-209266 | 9/1991 | Japan . |

TONER FOR DEVELOPING ELECTROSTATIC IMAGE, FORMING APPARATUS AND PROCESS CARTRIDGE

This application is a division of application Ser. No. 08/228,269 filed Apr. 15, 1994 U.S. Pat. No. 5,439,770.

FIELD OF THE INVENTION AND RELATED ART

The present invention relates to a toner, particularly a negatively chargeable toner, for developing electrostatic images in image forming methods, such as electrophotography, and electrostatic printing. The present invention also relates to a process cartridge and an image forming apparatus including the toner.

Hitherto, a large number of electrophotographic processes have been known, as disclosed in U.S. Pat. Nos. 2,297,691; 3,666,363; 4,071,361 and others. In these processes, an electric latent image is formed on a photosensitive member comprising a photoconductive material by various means, then the latent image is developed and visualized with a toner, and the resultant toner image is, after being transferred onto a transfer-receiving material, such as paper, as desired, fixed by heating, pressing, heating and pressing, etc., to obtain a copy or a print. In the case of including the step of transferring a toner image, a step of removing a residual toner remaining on the photosensitive member is ordinarily also included.

Known developing methods for visualizing electrical latent images with a toner may include, e.g., the magnetic brush method described in U.S. Pat. No. 2,874,063, the cascade developing method disclosed in U.S. Pat. No. 2,618,552, the powder cloud method disclosed U.S. Pat. No. 2,221,776, and a method using an electroconductive magnetic toner disclosed in U.S. Pat. No. 3,909,258.

The toners used in the above developing methods generally comprise fine powder comprising a dye or pigment dispersed in a natural or synthetic resin. An example of such toners comprises toner particles in the form of pulverized fine particles on the order of 1–30 μm each comprising a binder resin, such as polystyrene, and a colorant dispersed therein. There is also used a magnetic toner containing magnetic particles, such as magnetite powder. In the system of using a two-component type developer, a toner is used in the form of a mixture with carrier particles, such as glass beads, iron powder or ferrite powder.

Such a toner may generally contain a charge control agent for controlling the chargeability of the toner. In order to provide a toner with a negative chargeability, a chromium complex compound has been principally used.

As is described in Japanese Laid-Open Patent Application (JP-A) 60-170864, a chromium complex compound has a low dispersibility in a binder resin. As a result, there is a tendency that coarse particles and finer particles after a pulverization step for toner production contain different weight-basis contents of the charge control agent (chromium complex). If toner particles have different contents of a charge control agent, the toner particles are caused to have different charges and are liable to result in fog or a lowering in image density. In case where a fine powder fraction and a coarse powder fraction recovered from the classifying step are reutilized as a material for toner production, the above-mentioned liability of localization of a charge control agent is further liable to cause difficulties, such as a lowering in image density and fog due to a toner electrification insufficiency under a low-humidity condition. For this reason, it has been hitherto difficult to reutilize both fine powder and coarse powder by-produced in the classification step for toner production, and coarse powder alone has been reutilized as proposed in JP-A 3-209266. JP-A 61-155464 and JP-A 62-177561 have proposed an azo-type iron complex as a charge control agent showing good dispersibility within a binder resin. A toner containing the azo-type iron complex is, however, accompanied with difficulties, such as a slow rate of electrification and a lowering in image density after a long period of standing or in a high humidity environment. In recent years, a smaller particle size (at most 9 μm in terms of a weight-average particle size (diameter)) is recommended for providing high-quality images. A small particle size toner is liable to have a remarkable high charge under a low-humidity condition and cause difficulties, such as thinning of line images, a lowering in image density and occurrence of reversal potential fog caused by a toner charged to an opposite polarity due to charging failure on a developer-carrying member, such as a developing sleeve, due to the copresence of the excessively charged toner.

In order to improve the chargeability of a toner containing such an azo-type iron complex, JP-A 1-306862 has proposed a silicone resin-coated carrier which has a high chargeability-imparting effect, and JP-A 2-153362 has proposed a developing apparatus including an improved toner layer thickness-regulating member and an improved toner replenishment-assisting member. In these proposals, the developing performance of the toner is retained by charge-imparting or -assisting members and it is difficult to retain good image quality for a long period due to deterioration or soiling of the charge-imparting or -assisting member.

SUMMARY OF THE INVENTION

An object of the present invention is to provide a toner having solved the above-mentioned problems and capable of retaining a high-quality image forming performance for a long period.

An object of the present invention is to provide a toner having a uniform chargeability, capable of retaining a high image density for a long period and capable of providing images free from fog and with a high resolution.

Another object of the present invention is to provide a toner which can be quickly charged and can provide good toner images similarly as before standing even after standing for a long period or in a high-humidity environment.

Another object of the present invention is to provide a toner which can provide high-quality images without using a charge-assisting member.

Another object of the present invention is to provide a fine particle size toner which can provide satisfactory developed images for a long period under various environmental conditions even in case of providing high-resolution developed images.

Another object of the present invention is to provide a toner which allows re-utilization of fine powder and coarse powder by-produced in the classification step in toner production.

A further object of the present invention is to provide a process cartridge and an image forming apparatus including such a toner as described above.

According to the present invention, there is provided a toner for developing an electrostatic image, comprising: at least a binder resin and a charge control agent;

the binder resin having an acid value of 5–50;

the charge control agent comprising an iron complex represented by the following formula:

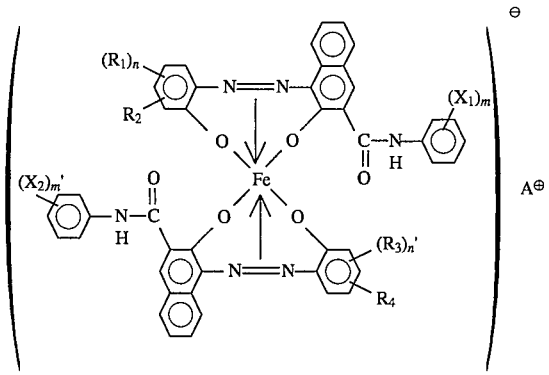

wherein $X_1$ and $X_2$ independently denote hydrogen atom, lower alkyl group, lower alkoxy group, nitro group or halogen atom; m and m' denote an integer of 1–3; $R_1$ and $R_3$ independently denote hydrogen atom, $C_{1-18}$ alkyl or alkenyl, sufonamide, mesyl, sulfonic acid group, carboxy ester group, hydroxy, $C_{1-18}$ alkoxy, acetylamino, benzoylamino or halogen atom; n and n' denote an integer of 1–3; $R_2$ and $R_4$ denote hydrogen atom or nitro group; and $A^{\oplus}$ denotes hydrogen ion, sodium ion, potassium ion or ammonium ion;

the toner having a weight-average particle size ($D_4$) of 4–9 μm and including toner particles having a particle size of 5 μm or smaller at 3–90% by number, toner particles having a particle size of 6.35–10.08 μm at 1–80% by number and toner particles having a particle size of 12.7 μm or larger at a percentage by volume of at most 2.0%, wherein the toner particles having a particle size of 5.0 μm or smaller are contained at N % by number and at V % by volume satisfying a relationship:

$$N/V=-0.05N+k,$$

wherein k is a positive number in the range of 3.0–7.5.

According to another aspect of the present invention, there is provided an image forming apparatus, comprising: an electrostatic image-bearing member for holding an electrostatic image thereon, and a developing apparatus for developing the electrostatic image; said developing apparatus including a developer container for storing a developer and a developer-carrying member for carrying thereon and conveying the developer from the developer container to a developing region confronting the electrostatic image-bearing member;

wherein the developer contains the above-mentioned toner for developing an electrostatic image.

According to a further aspect of the present invention, there is provided a process cartridge detachably mountable to a main assembly of an image forming apparatus, comprising an electrostatic image-bearing member and a developing means for developing the electrostatic image formed on the electrostatic image bearing member with a developer;

wherein the developer contains the above-mentioned toner for developing an electrostatic image.

These and other objects, features and advantages of the present invention will become more apparent upon a consideration of the following description of the preferred embodiments of the present invention taken in conjunction with the accompanying drawings, wherein like parts or members are denoted by like reference numerals.

DETAILED DESCRIPTION OF THE INVENTION

Figure 1:
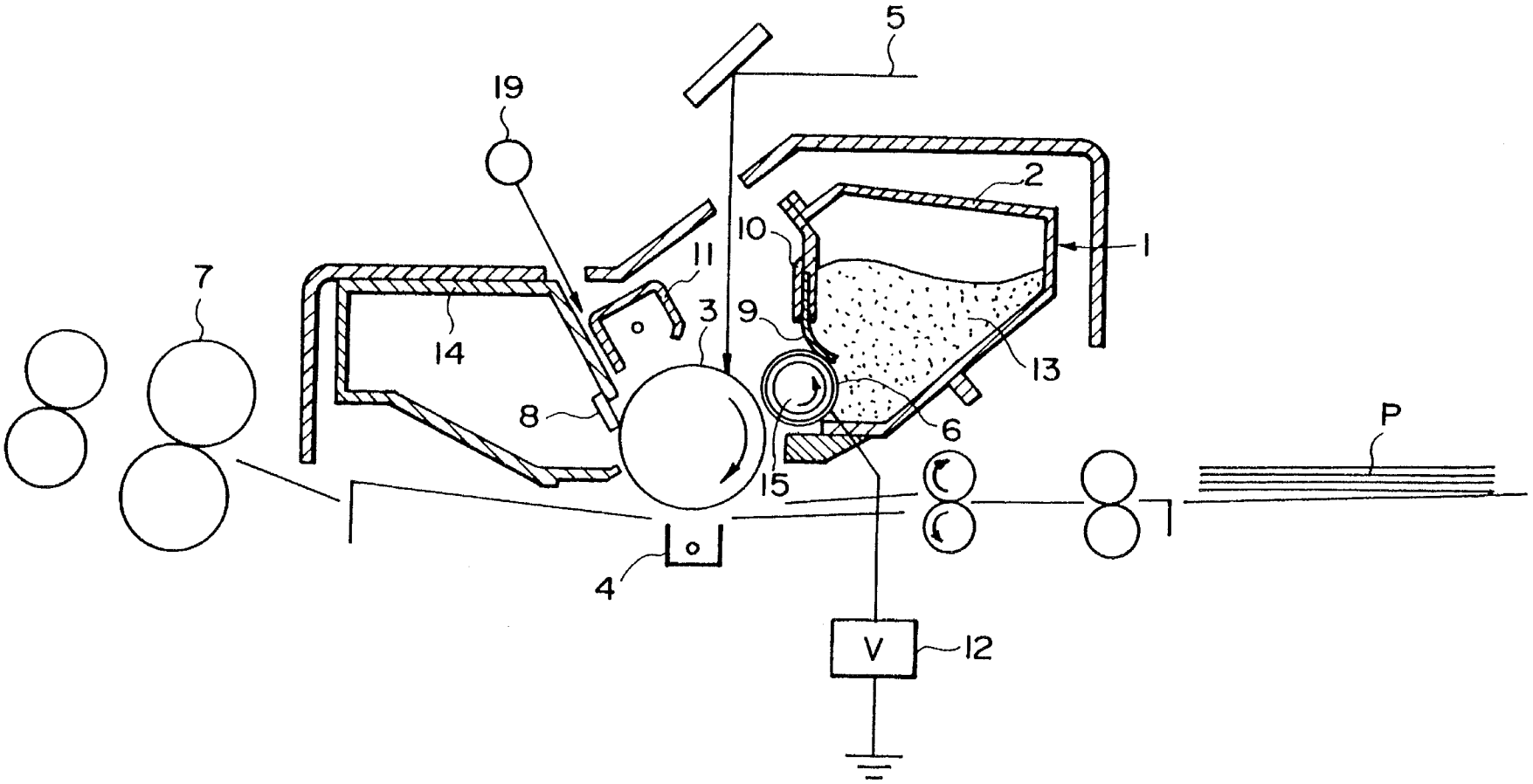
FIG. 1 is a schematic illustration of an embodiment of the image forming apparatus according to the present invention equipped with an elastic blade.

The toner according to the present invention will be described in further detail hereinbelow.

An azo-type iron complex, when used as a charge control agent for an electrophotographic toner, shows a good dispersibility in a binder resin but provides a toner which shows an insufficient charging speed under a high-humidity condition and fails to provide a sufficient image density at an initial stage or a long period of standing under a high-humidity condition. Under a low-humidity condition, in a long period of continual use, the toner is liable to cause an accumulation of an excessive triboelectric charge (charge-up), thus resulting in images with a low image density and noticeable fog.

In contrast thereto, an azo-type chromium complex shows a rather poor dispersibility within a binder resin but forms an aggregation of primary particles (micro-domain) thereof in the binder resin, thereby showing a good charge controllability to alleviate the above-mentioned problems. However, because of a rather poor dispersibility within a binder resin as described above, such an azo-type chromium complex causes a large degree of fluctuation in content thereof among a fine powder fraction, a medium powder fraction and a coarse powder fraction resultant after the classification step during toner production. As a result, in the case where a toner is produced by using an azo-type chromium complex as a charge control agent, and of the fine powder fraction and the coarse powder fraction is re-utilized for toner production, the resultant toner is liable to cause a large difference in content of the azo-type chromium complex among toner particles, thus causing a remarkable decrease in image density and noticeable fog in a long term of continual use in a low-humidity environment.

We have discovered that, when an azo-type iron complex and a binder resin having a certain acid value are used in combination, an aggregation of primary particles (micro-domain) of the azo-type iron complex is formed within the binder resin to show an enhanced charge controlling ability and provide to toner with a remarkably increased developing performance as a synergistic effect in combination with the charge controllability of the binder resin having an acid value, thus providing excellent images having a high image density and with little fog. The azo-type iron complex, while it forms microdomains in a resin having an acid values, causes very little fluctuation in content thereof among fine powder, medium powder and coarse powder resultant after a classification step in toner production. It has been found therefore that the re-utilization of the fine powder and coarse powder by-produced in toner production for a fresh toner production is not accompanied with any problems.

The localization of an azo-type metal complex in classified fine powder, classified medium powder (used as a toner) and classified coarse powder resultant after a classification step in a toner production process using the azo-type metal complex is evaluated in the following manner. Each powder fraction is weighed in a prescribed amount within a range of 1.0–3.0 g and is dispersed in 200 ml of ethyl alcohol under stirring for 48 hours, followed by filtration to recover a filtrate. Then, the absorption spectrum in the visible range of the filtrate is obtained and a relative absorbance at a wavelength showing an absorption, e.g., $\lambda$=480 nm, attributable to the metal complex is measured. The localization characteristic of the metal complex is evaluated by factors (ratios):

$$OD_F/OD_M \text{ and } OD_C/OD_M,$$

wherein $OD_F$ denotes an absorbance of a filtrate obtained from classified fine powder, $OD_M$ denotes an absorbance of a filtrate obtained from classified medium powder and $OD_C$ denotes an absorbance of a filtrate obtained from classified coarse powder.

The localization characteristics of an azo-type iron complex and an azo-type chromium complex in a binder resin having an acid value were evaluated in the above-described manner. As a result, in case of the azo-type iron complex, $OD_F/OD_M$ and $OD_C/OD_M$ are both within the range of 0.95–1.05 showing little localization. In the case of the azo-type chromium complex, $OD_F/OD_M$ exceeded 1.20 and $OD_C/OD_M$ was below 0.85, thus showing a large degree of localization. In the case of using a combination of a binder resin having no acidic group and an azo-type iron complex, the iron complex showed a similar degree of localization as in the above-mentioned case of using the binder resin having an acid value.

We consider that the remarkable difference in developing performance in spite of the identical degree of localization suggests that the azo-type iron complex forms a microdomain in combination with the resin having an acid value.

A resin having an acid value of 5–50 constituting the binder resin may include a polyester resin as an example.

The polyester resin used in the present invention may preferably have a composition that it comprises 45–55 mol. % of alcohol component and 55–45 mol. % of acid component.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

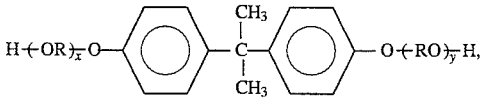

(A)

wherein R denotes an ethylene or propylene group, x and y are independently 0 or a positive integer with the proviso that the average of x+y is in the range of 0–10; diols represented by the following formula (B):

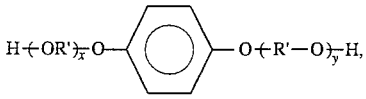

(B)

wherein R' denotes

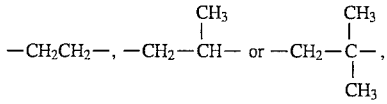

x' and y' are independently 0 or a positive integer with the proviso that the average of x'+y' is in the range of 0–10; and polyhydric alcohols, such as glycerin, sorbitol and sorbitan.

Examples of the dibasic acid constituting at least 50 mol. % of the total acid may include benzenedicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides; $C_6$–$C_{18}$ alkyl or alkenyl-substituted succinic acids, and their anhydrides; and unsaturated dicarboxylic acids, such as fumaric acid, maleic acid, citraconic acid and iraconic acid, and their anhydrides.

Examples of polybasic carboxylic acids having three or more functional groups may include: trimellitic acid, pyromellitic acid, benzophenonetetracarboxylic acid, and their anhydride.

An especially preferred class of alcohol components constituting the polyester resin is a bisphenol derivative represented by the above formula (A), and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride; and tricarboxylic acids such as trimellitic acid and its anhydride.

The polyester resin may preferably have a glass transition temperature of 40°–90° C., particularly 44°–85° C., a number-average molecular weight (Mn) of 1,500–50,000, particularly 2,000–20,000, and a weight-average molecular weight (Mw) of $10^4$–$5\times10^6$, particularly $1.5\times10^4$–$3\times10^6$.

A vinyl-type copolymer may also be used as another example of the resin having an acid value of 5–50.

Examples of a vinyl monomer providing an acid value may include: $\alpha,\beta$-unsaturated dicarboxylic acids, and anhydrides or half esters thereof, such as a maleic acid, monobutyl fumarate, monooctyl maleate, maleic anhydride, fumaric acid, and monobutyl maleate; alkenyl-dicarboxylic acids, and anhydrides or half esters thereof, such as n-butenylsuccinic acid, n-octenylsuceinic acid, n-butenylsuccinic anhydride, monobutyl n-butenylsuccinate, n-butenylmalonic acid, n-dodecenylglutaric acid, and n-butenyladipic acid; and $\alpha,\beta$-unsaturated monocarboxylic acids, such as acrylic acid and metnacrylic acid.

Examples of a vinyl monomer to be used together with the above-mentioned acidic vinyl monomer for providing the vinyl copolymer having an acid value may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the above-mentioned α,β-unsaturated acids and the diesters of the above-mentioned dibasic acids. These vinyl monomers may be used singly or in combination of two or more species.

Among these, a combination of monomers providing styrene-type copolymers and styrene-acrylic type copolymers may be particularly preferred.

The vinyl copolymer used in the present invention can include a crosslinking structure obtained by using a crosslinking monomer, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K. K.). Polyfunctional crosslinking agents, such as pentaerythritol triacrylate, trimethylolethane triacrylate, tetramethylolmethane tetracrylate, oligoester acrylate, and compounds obtained by substituting methacrylate groups for the acrylate groups in the above compounds; triallyl cyanurate and triallyl trimellitate.

The vinyl copolymer may preferably have a glass transition temperature of 40°–90° C., more preferably 45°–85° C., a number-average molecular weight (Mn) of 1,500–50,000, more preferably 2,000–20,000, and a weight-average molecular weight (Mw) of 10,000–5,000,000, more preferably 15,000–3,000,000.

The binder resin constituting the toner of the present invention may have an acid value of 5–50, preferably 6–45, more preferably 7–40.

If the acid value is below 5, the azo-type iron complex as a charge control agent cannot form sufficient microdomains, so that the resultant toner is liable to cause a lowering in image density and provide foggy images during a continuous image formation in a low humidity environment.

In case where the acid value exceeds 50, the resultant toner is liable to provide images with a low image density in a high humidity environment, presumably because of an excessive charge relaxation effect due to the acid group.

The resin used in the present invention inclusive of the polyester resin and the vinyl copolymer resin may preferably have an OH value of at most 50, more preferably at most 30. In case where the OH value exceeds 50, the resultant toner is liable to provide images with a low image density in a high humidity environment.

In addition to the resin having an acid value, it is possible to use another resin, such as styrene-butadiene copolymer resin, polyurethane, polyamide, epoxy resin, or polyvinyl butyral resin.

The resin having an acid value may preferably be contained in a proportion of at least 50 wt. %, more preferably at least 60 wt. %, of the binder resin.

The acid value (mgKOH/g) and OH value (mgKOH/g) of a resin may be measured in the following manner.

For the measurement of an acid value, 2–10 g of a sample resin is weighed in a 200 to 300 ml-Erlenmeyer flask, and about 50 ml of a methanol/toluene (=30/70) mixture solvent is added thereto to dissolve the resin. In case of poor solubility, a small amount of acetone may be added. The solution is titrated with an N/10 KOH/alcohol solution standardized in advance with the use of a 0.1% indicator mixture of bromothymol blue and phenol red. The acid value is calculated from the consumption of the KOH/alcohol solution based on the following equation:

$$\text{Acid value} = \text{vol. (ml) of KOH/alcohol} \times N \times 56.1/\text{sample weight} \quad (1)$$

wherein N denotes the factor of the N/10 KOH/alcohol solution.

For the measurement of an OH value (hydroxyl value), a sample resin is subjected to acetylation by heating with an excessive amount of an acetylating agent, such as anhydrous acetic acid, and the saponification value (A) of the acetylated product is measured. An OH value of the sample resin is calculated based on the measured value (A) of the acetylated product and the saponification value (B) of the sample resin before the acetylation according to the following equation (2):

$$\text{OH value} = A/(1-0.00075A) - B \quad (2)$$

The azo-type iron complex used in the present invention has a structure represented by the following general formula:

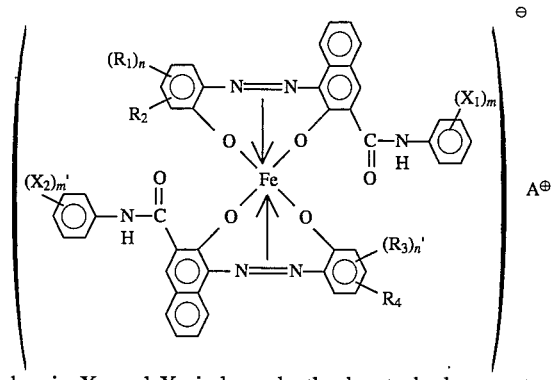

wherein $X_1$ and $X_2$ independently denote hydrogen atom, lower alkyl group, lower alkoxy group, nitro group or halogen atom; m and m' denote an integer of 1–3; $R_1$ and $R_3$ independently denote hydrogen atom, $C_{1-18}$ alkyl or alkenyl, sufonamide, mesyl, sulfonic acid group, carboxy ester group, hydroxy, $C_{1-18}$ alkoxy, acetylamino, benzoylamino or halogen atom; n and n' denote an integer of 1–3; $R_2$ and $R_4$ denote hydrogen atom or nitro group; and $A^{\oplus}$ denotes hydrogen ion, sodium ion, potassium iron or ammonium ion.

The above azo-type iron complex which is suitably used as a negative charge control agent may be synthesized according to a known process.

Representative examples of the azo-type iron complex represented by the above formula may include those having structures as shown below:

Iron Complex (1)

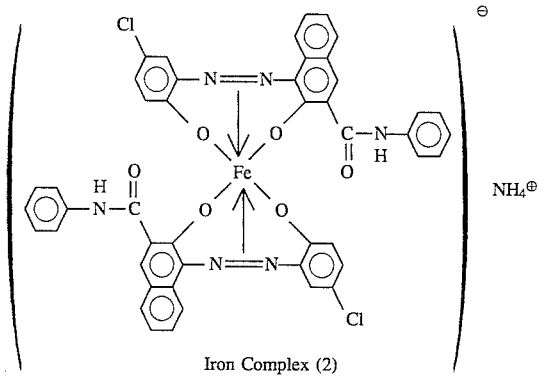

Iron Complex (2)

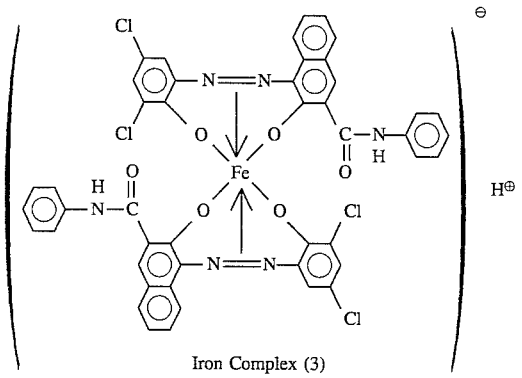

Iron Complex (3)

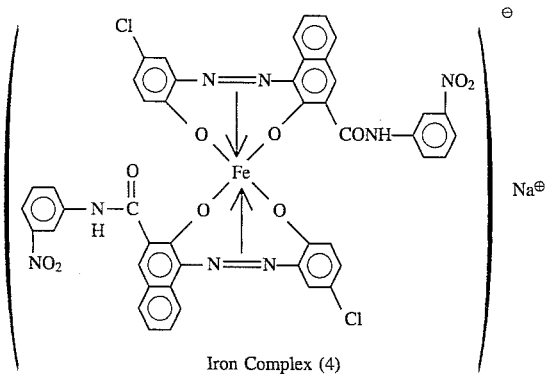

Iron Complex (4)

-continued

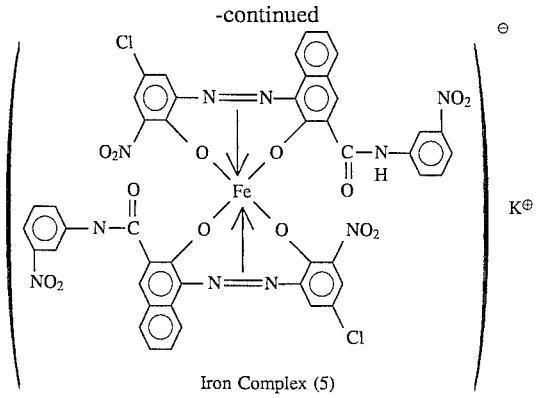

Iron Complex (5)

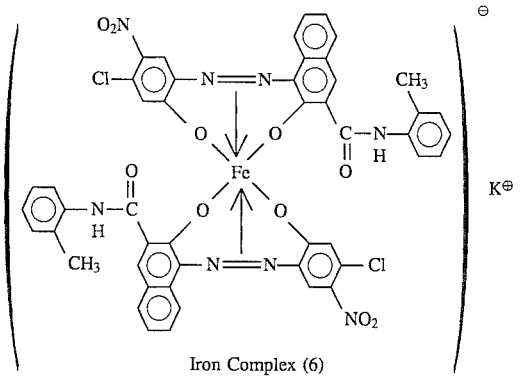

Iron Complex (6)

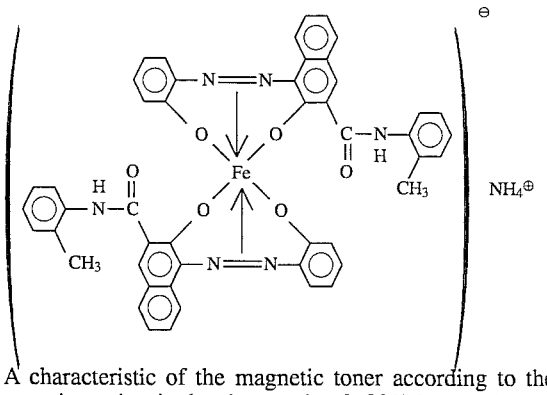

A characteristic of the magnetic toner according to the present invention is that it contains 3–90% by number of toner particles having a particle size of 5 μm or smaller. Hitherto, it has been considered difficult to control the charge imparted to toner particles of 5 μm or smaller. Further, such fine toner particles are considered to impair the fluidity of the toner, soil the carrier and developing sleeve, cause cleaning failure and filming onto the drum and scatter to soil the interior of an image forming apparatus. Thus, it has been considered necessary to remove or decrease toner particles of 5 μm or smaller.

As a result of our study, however, in case of a toner comprising a polyester resin or vinyl copolymer having an acid value of 5–50 and an azo-type iron complex of the above-mentioned formula, it has been found that toner particles of 5 μm or smaller are very effective for providing images of a fine definition and a high resolution.

Another characteristic of the toner used in the present invention is that toner particles of 6.35–10.09 μm constitute 1–80% by number. Toner particles of 5 μm or smaller are able to strictly cover and faithfully reproduce an electrostatic image, but an electrostatic image per se has a higher electric field intensity at the peripheral edge than the middle or central portion. As a result, toner particles are attached to the central portion in a smaller thickness than to the peripheral part, so that the inner part is liable to be thin in density. We have found that this problem can be solved to provide a clear image by using toner particles of 6.35–10.08 μm in a proportion of 1–80% by number. This may be attributable to a fact that toner particles of 6.35–10.08 μm are supplied to an inner part having a smaller intensity than the edge of a latent image presumably because they have a moderately controlled charge relative to toner particles of 5 μm or smaller, thereby to compensate for the less coverage of toner particles and result in a uniform developed image. As a result, a sharp image having a high density and excellent in resolution and gradation characteristic can be attained.

Another characteristic is that the contents of the toner particles of 5 μm or smaller in terms of % by number (N %) and % by volume (V %) satisfy the relationship of $N/V=-0.05N+k$, wherein $3.0 \leqq k \leqq 7.5$, and $1 \leqq N \leqq 80$. The toner having a particle size distribution satisfying the relationship in combination with the other characteristic features according to the present invention accomplishes a better developing performance with respect to a digital latent image composed of minute spots.

We have found a certain state of presence of fine powder accomplishing the intended performance satisfying the above formula during our study on the particle size distribution with respect to particles of 5 μm or smaller. For a certain value of N, a large N/V value is understood to mean that a large proportion of particles smaller than 5 μm are present with a broad particle size distribution, and a small N/V value is understood to mean that particles having a particle size in the neighborhood of 5 μm is present in a large proportion and particles smaller than that are present in a small proportion. Within the range of 1–80 for N, a further better thin-line reproducibility and high resolution in a large quantity of copying or printing are accomplished when the N/V is in the range of 1.0–7.45 and further satisfies the above formula relationship.

Toner particles of 12.7 μm or larger are suppressed to be not more than 2.0% by volume. The fewer, the better.

The particle size distribution of the toner used in the present invention is described more specifically below.

Toner particles of 5 μm or smaller may be contained in a proportion of 3–90% by number, preferably 5–80% by number, further preferably 9–75% by number, of the total number of particles. If the content of the magnetic toner particles of 5 μm or smaller is below 3% by number, a portion of the magnetic toner particles effective for providing a high image quality is few and particularly, as the toner is consumed during a continuation of copying or printing-out, the effective component is preferentially consumed to result in an awkward particle size distribution of the toner and gradually deteriorates the image quality. If the content is above 90% by number, mutual agglomeration of the magnetic toner particles and charge-up are liable to occur, thus leading to difficulties, such as cleaning failure, a low image density, and a large difference in density between the contour and interior of an image to provide a somewhat hollow image.

It is preferred that the content of the particles in the range of 6.35–10.08 μm is 1–80% by number, further preferably 5–70% by number. Above 80% by number, the image quality becomes worse, and excess of toner coverage is liable to occur, thus resulting in a lower thin-line reproducibility and an increased toner consumption. Below 5% by number, it becomes difficult to obtain a high image density in some cases. The contents of the toner particles of 5 μm or smaller in terms of % by number (N %) and % by volume (V %) may preferably satisfy the relationship of $N/V=-0.05N+k$, wherein k represents a positive number satisfying $3.0 \leqq k \leqq 7.5$, preferably $3.1 \leqq k \leqq 7.4$, further preferably $3.2 \leqq k \leqq 7.3$, and N is a number satisfying $5 \leqq N \leqq 80$, more preferably $9 \leqq N \leqq 75$.

If $k<3.0$, magnetic toner particles of 5.0 μm or below are insufficient, and the resultant image density, resolution and sharpness decrease. When fine toner particles in a magnetic toner, which have conventionally been considered useless, are present in an appropriate amount, they are effective for achieving closest packing of toner in development and contribute to the formation of a uniform image. Particularly, these particles fill thin-line portions and contour portions of an image, thereby to visually improve the sharpness thereof. On the other hand, if $k>7.5$, an excess of fine powder is present, whereby the balance of particle size distribution can be disturbed during successive copying or print-out, thus leading to difficulties such as a somewhat lower image density and filming.

The amount of toner particles having a particle size of 12.7 μm or larger is 2.0% by volume or smaller, preferably 1.0% by volume or smaller, more preferably 0.5% by volume or smaller. If the above amount is larger than 2.0% by volume, these particles are liable to impair thin-line reproducibility.

The toner used in the present invention may have a weight-average particle size of 4–9 μm. This value cannot be considered separately from the above-mentioned factors. If the weight-average particle size is below 4 μm, the toner is liable to cause soiling of the interior of an apparatus with scattered toner, a lowering in image density in a low-humidity environment and cleaning failure of the photosensitive member. If the weight-average particle size exceeds 9 μm, a minute spot of 100 μm or smaller cannot be developed with a sufficient resolution and noticeable scattering to non-image part is observed, thus being liable to provide inferior images.

The particle size distribution of a toner is measured by means of a Coulter counter in the present invention, while it may be measured in various manners.

Coulter counter Model TA-II or Coulter Multisizer II (available from Coulter Electronics Inc.) is used as an instrument for measurement, to which an interface (available from Nikkaki K. K.) for providing a number-basis distribution, and a volume-basis distribution and a personal computer PC 9801 (available from NEC K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 μm by using the above-mentioned Coulter counter Model TA-II or Coulter Multisizer II with a 100 micron-aperture to obtain a volume-basis distribution and a number-basis distribution. Form the results of the volume-basis distribution and number-basis distribution in the range of 2–40 μm, a weight-average particle size ($D_4$) is calculated with a central value of each channel taken as a representative value of the channel.

The toner for developing electrostatic images according to the present invention may preferably contain the above-mentioned azo-type iron complex in a proportion of 0.1–10 wt. parts, more preferably 0.1–5 wt. parts, per 100 wt. parts of the binder resin.

The toner according to the present invention may be either a magnetic toner or a non-magnetic toner. In order to constitute a magnetic toner, it is preferred to use a magnetic material as described below in view of the chargeability, fluidity, uniformity of resultant image density, etc.

Examples of the magnetic material contained in the insulating magnetic toner used in the present invention may include: iron oxides, such as magnetite, hematite, and ferrite; iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). The above magnetic materials may be used singly or in mixture of two or more species. Particularly suitable magnetic material for the present invention is fine powder of triiron tetroxide or $\gamma$-diiron trioxide.

The magnetic material may have an average particle size (Dav.) of 0.1–2 μm, preferably 0.1–0.3 μm. The magnetic material may preferably show magnetic properties when measured by application of 10 kilo-Oersted, inclusive of: a coercive force (Hc) of 20–150 Oersted, a saturation magnetization ($\sigma s$) of 50–200 emu/g, particularly 50–100 emu/g, and a residual magnetization ($\sigma r$) of 2–20 emu/g.

The magnetic material may be contained in the toner in a proportion of 10–200 wt. parts, preferably 20–150 wt. parts, per 100 wt. parts of the binder resin.

The toner according to the present invention may optionally contain a colorant, inclusive of arbitrary pigments or dyes.

Examples of the pigment may include: carbon black, aniline black, acetylene black, Naphthol Yellow, Hansa Yellow, Rhodamine Lake, Alizarine Lake, red iron oxide, Phthalocyanine Blue, and Indanthrene Blue. It is preferred to use 0.1–20 wt. parts, particularly 1–10 wt. parts, of a pigment per 100 wt. parts of the binder resin. For similar purpose, there may also be used dyes, such as azo dyes, anthraquinone dyes, xanthene dyes, and methine dyes, which may preferably be used in an amount of 0.1–20 wt. parts, particularly 0.3–10 wt. parts, per 100 wt. parts of the resin.

In the present invention, it is also possible to incorporate one or two or more species of release agent, as desired within, a toner.

Examples of the release agent may include: aliphatic hydrocarbon waxes, such as low-molecular weight polyethylene, low-molecular weight polypropylene, microcrystalline wax, and paraffin wax, oxidation products of aliphatic hydrocarbon waxes, such as oxidized polyethylene wax, and block copolymers of these; waxes containing aliphatic esters as principal constituents, such as carnauba wax, montanic acid ester wax, and partially or totally deacidified aliphatic esters, such as deacidified carnauba wax. Further examples of the release agent may include: saturated linear aliphatic acids, such as palmitic acid, stearic acid, and montanic acid; unsaturated aliphatic acids, such as brassidic acid, eleostearic acid and parinaric acid; saturated alcohols, such as stearyl alcohol, behenyl alcohol, ceryl alcohol, and melissyl alcohol; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, and ethylene-biscaprylamide; unsaturated aliphatic acid amides, such as ethylene-bisolerylamide, hexamethylene-bisoleylamide, N,N'-dioleyladipoylamide, and N,N'-dioleylsebacoylamide, aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

The particularly preferred class of release agent in the present invention may include aliphatic hydrocarbon waxes because of good dispersibility within the resin having an acid value of 5–50, thus providing not only a good fixability of the resultant toner but also a minimum abrasion of an organic photoconductor when used in combination with the toner according to the present invention.

Specific examples of the release agent preferably used in the present invention may include e.g., a low-molecular weight alkylene polymer obtained through polymerization of an alkylene by radical polymerization under a high pressure or in the presence of a Ziegler catalyst under a low pressure; an alkylene polymer obtained by thermal decomposition of an alkylene polymer of a high molecular weight; and a hydrocarbon wax obtained by subjecting a mixture gas containing carbon monoxide and hydrogen to the Arge process to form a hydrocarbon mixture and distilling the hydrocarbon mixture to recover a residue. Fractionation of wax may preferably be performed by the press sweating method, the solvent method, vacuum distillation or fractionating crystallization. As the source of the hydrocarbon wax, it is preferred to use hydrocarbons having up to several hundred carbon atoms as obtained through synthesis from a mixture of carbon monoxide and hydrogen in the presence of a metal oxide catalyst (generally a composite of two or more species), e.g., by the Synthol process, the Hydrocol process (using a fluidized catalyst bed), and the Arge process (using a fixed catalyst bed) providing a product rich in waxy hydrocarbon, and hydrocarbons obtained by polymerizing an alkylene, such as ethylene, in the presence of a Ziegler catalyst, as they are rich in saturated long-chain linear hydrocarbons and accompanied with few branches. It is further preferred to use hydrocarbon waxes synthesized without polymerization because of their structure and molecular weight distribution suitable for easy fractionation.

As for the molecular weight distribution of the wax, it is preferred that the wax shows a peak in a molecular weight region of 400–2400, further 450–2000, particularly 500–1600. By satisfying such molecular weight distribution, the resultant toner is provided with preferable thermal characteristics.

The release agent may preferably be used in an amount of 0.1–20 wt. parts, particularly 0.5–10 wt. parts, per 100 wt. parts of the binder resin.

The release agent may be uniformly dispersed in the binder resin by a method of mixing the release agent in a solution of the resin at an elevated temperature under stirring or melt-kneading the binder resin together with the release agent.

A flowability-improving agent may be blended with the toner to improve the flowability of the toner. Examples thereof may include: powder of fluorine-containing resin, such as polyvinylidene fluoride fine powder and polytetrafluoroethylene fine powder; titanium oxide fine powder, hydrophobic titanium oxide fine powder; fine powdery silica such as wet-process silica and dry-process silica, and treated silica obtained by surface-treating such fine powdery silica with silane coupling agent, titanium coupling agent, silicone oil, etc.

A preferred class of the flowability-improving agent includes dry process silica or fumed silica obtained by vapor-phase oxidation of a silicon halide. For example, silica powder can be produced according to the method utilizing pyrolyric oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

It is preferred to use fine silica powder having an average primary particle size of 0.001–2 μm, particularly 0.002–0.2 μm.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | OX 50 |
| | TT 600 |
| | MOX 80 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

It is further preferred to use treated silica fine powder obtained by subjecting the silica fine powder formed by vapor-phase oxidation of a silicon halide to a hydrophobicity-imparting treatment. It is particularly preferred to use treated silica fine powder having a hydrophobicity of 30–80 as measured by the methanol titration test.

Silica fine powder may be imparted with a hydrophobicity by chemically treating the powder with an organosilicone compound, etc., reactive with or physically adsorbed by the silica fine powder.

Example of such an organosilicone compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxvsilane, dimethylethoxysilane, dimethyldimethoxysihane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

The flowability-improving agent used in the present invention may have a specific surface area of at least 30 $m^2/g$, preferably 50 $m^2/g$, as measured by the BET method according to nitrogen adsorption. The flowability-improving agent may be used in an amount of 0.01–8 wt. parts, preferably 0.1–4 wt. parts, per 100 wt. parts of the toner.

In case where the toner according to the present invention is used for constituting a two-component type developer, the toner is blended with a carrier. Examples of the carrier used in the present invention may include: surface-oxidized or -unoxidized powder of metals, such as iron, nickel, copper, zinc, cobalt, manganese, chromium and rare earth metals, particles of alloys of these metal, oxide particles, and ferrite particles.

A coated carrier obtained by coating the above carrier particles with a resin may preferably be used particularly in a developing method wherein a developing bias is supplied with an AC bias voltage. The coating may be performed according to known methods inclusive of a method applying a coating liquid obtained by dissolving or suspending a coating material such as a resin into a solvent onto the surface of carrier core particles, and a method of powder blending carrier core particles and a coating material.

Examples of the coating material firmly applied onto the core particles may include: polytetrafluoroethylene, monochlorotrifluoroethylene polymer, polyvinylidene fluoride, silicone resin, polyester resin, styrene resin, acrylic resin, polyamide, polyvinyl butyral, aminoacrylate resin, basic dyes and lakes thereof, silica fine powder and alumina fine powder. These coating materials may be used singly or in combination of plural species.

The coating material may be applied onto the core particles in a proportion of 0.1–30 wt. %, preferably 0.5–20 wt. %, based on the carrier core particles. The carrier may preferably have an average particle size of 10–100 μm, more preferably 20–70 μm.

A particularly preferred type of carrier may comprise particles of a magnetic ferrite such as Cu-Zn-Fe ternary ferrite surface-coated with a fluorine-containing resin or a styrene-based resin. Preferred coating materials may include mixtures of a fluorine containing resin and a styrene copolymer, such as a mixture of polyvinylidene fluoride and styrene-methyl methacrylate resin, and a mixture of polytetraluforoethylene and styrene-methyl methacrylate resin. The fluorine-containing resin may also be a copolymer, such as vinylidene fluoride/tetrafluoroethylene (10/90–90/10) copolymer. Other examples of the styrene-based resin may include styrene/2-ethylhexyl acrylate (20/80–80/20) copolymer and styrene/2-ethylhexyl acrylate/methyl methacrylate (20–60/5–30/10–50) copolymer. The fluorine-containing resin and the styrene-based resin may be blended in a weight ratio of 90:10–20:80, preferably 70:30–30:70. The coating amount may be 0.01–5 wt. %, preferably 0.1–1 wt. % of the carrier core.

The coated magnetic ferrite carrier may preferably include at least 70 wt. % of particles of 250 mesh-pass and 400 mesh-on, and have an average particle size of 10–100 μm, more preferably 20–70 μm. A sharp particle size distribution is preferred. The above-mentioned coated magnetic ferrite carrier shows a preferable triboelectric charging performance for the toner according to the invention and provides a two-component type developer with improved electrophotographic performances.

The toner according to the invention and a carrier may be blended in such a ratio as to provide a toner concentration of 2–15 wt. %, preferably 4–13 wt. %, whereby good results are obtained ordinarily.

The toner for developing electrostatic images according to the present invention may be produced by sufficiently mixing a binder resin, a magnetic material, a release agent and optional additives, such as a colorant, a charge control agent and others, by means of a mixer such as a Henschel mixer or a ball mill; then melting and kneading the mixture by hot kneading means such as hot rollers, kneader and extruder to disperse or dissolve the resin and others; cooling and pulverizing the mixture; and subjecting the pulverized product to classification to recover the toner of the present invention.

Further, the toner may be sufficiently blended with a flowability-improving agent by a mixer, such as a Henschel mixer to attach the additive to the toner particles, whereby a toner according to the present invention is produced.

The glass transition temperature and molecular weight may be measured according to the following methods.

(1) Glass transition temperature Tq

Measurement may be performed in the following manner by using a differential scanning calorimeter ("DSC-7", available from Perkin-Elmer Corp.).

A sample in an amount of 5–20 mg, preferably about 10 mg, is accurately weighed.

The sample is placed on an aluminum pan and subjected to measurement in a temperature range of 30°–200 ° C. at a temperature-raising rate of 10° C./min in a normal temperature—normal humidity environment in parallel with a blank aluminum pan as a reference.

In the course of temperature increase, a main absorption peak appears in the temperature region of 40°–100° C.

In this instance, the glass transition temperature is determined as a temperature of an intersection between a DSC curve and an intermediate line pressing between the base lines obtained before and after the appearance of the absorption peak.

(2) Molecular weight distribution

The molecular weight (distribution) of a binder resin may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min., and 50–200 μl of a GPC sample solution adjusted at a concentration of 0.05–0.6 wt. % is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K. K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3$–$2\times10^6$. A preferred example thereof may be a combination of μ-styragel 500, $10^3$, $10^4$ and $10^5$ available from Waters Co; a combination of Shodex KF-801, 802, 803, 804 and 805 available from Showa Denko K. K.; or a combinations of TSK gel G1000H, G2000H, G2500H, G3000H, G4000H, G5000H, G6000H, G7000H, and GMH available from Toso K. K.

An operation of a preferred embodiment of the image forming apparatus according to the present invention will be described with reference to FIG. 1.

The surface of a photosensitive drum 3 is negatively charged by a primary charger 11 and is subjected to image scanning with a laser beam 5 to form a digital latent image thereon. The latent image is developed by reversal development with a one component type developer 13 comprising a negatively chargeable magnetic toner in a developing apparatus 1 having a developing sleeve 6 which is equipped with a urethane rubber-made elastic blade 9 disposed in a counter direction with the sleeve 6 and contains a magnet 15 therein. Alternatively, a positively charged electrostatic image formed an amorphous silicon photosensitive member may be subjected to normal development. The developing sleeve 6 is supplied with an alternating bias, a pulse bias and/or a DC bias. A transfer-receiving paper P conveyed to a transfer position, where the backside (side opposite to the photosensitive drum 3) of the paper P is charged by an electrostatic transfer means 4, so that a developed image (toner image) on the photosensitive drum surface is electrostatically transferred to the paper P. The paper P separated from the photosensitive drum 3 is subjected a fixing treatment by a hot pressure fixing device 7 to fix the toner image onto the paper P.

The one-component type developer remaining on the photosensitive drum 3 after the transfer step is removed by a cleaning device 14 having a cleaning blade 8. The photosensitive drum 3 after the cleaning is charge-removed by an erasure exposure means 19. Thereafter, the above-mentioned cycle starting from the charging step by the primary charger 11 is repeated.

The photosensitive drum (electrostatic image-bearing member) 3 comprises an electroconductive substrate and a photosensitive layer thereon and rotates in a direction of an indicated arrow. The developing sleeve 6 of a non-magnetic cylinder as a developer-carrying member rotates so as to move in a direction identical to the photosensitive drum 3 at the developing position. Inside the developing sleeve 6 of a non-magnetic cylinder is disposed a multi-polar permanent magnet (magnet roll) 15 as a magnetic field-generating means so as not to rotate. The one-component-type insulating developer 13 in the developing apparatus 1 is applied onto the developing sleeve 6 surface and is provided with a negative triboelectric charge due to friction between the developing sleeve 6 surface and the magnetic toner particles. Further, by disposing an elastic doctor blade 9, the developer layer thickness is uniformly regulated to a small thickness (30 μm–300 μm) which is smaller than a spacing between the photosensitive drum 3 and the developing sleeve 6 so that the developer layer on the sleeve 6 does not contact the photosensitive drum 3 at the developing position. The rotational speed of the sleeve 6 is regulated so that the sleeve surface speed is substantially identical to that of the electrostatic image-bearing surface or close thereto.

The developing sleeve 6 may be supplied with an AC bias or a pulse bias by a bias voltage supply means 12. The AC bias may preferably comprise a frequency (f) of 200–4000 Hz and a Vpp of 500–3000 volts.

At the developing position, the magnetic toner particles on the developing sleeve 6 are transferred toward an electrostatic image on the photosensitive drum 3 surface under the action of the electrostatic force of the electrostatic image and the aC bias or pulse bias.

Another embodiment of the image forming apparatus according to the present invention is described with reference to FIG. 2.

Figure 2:
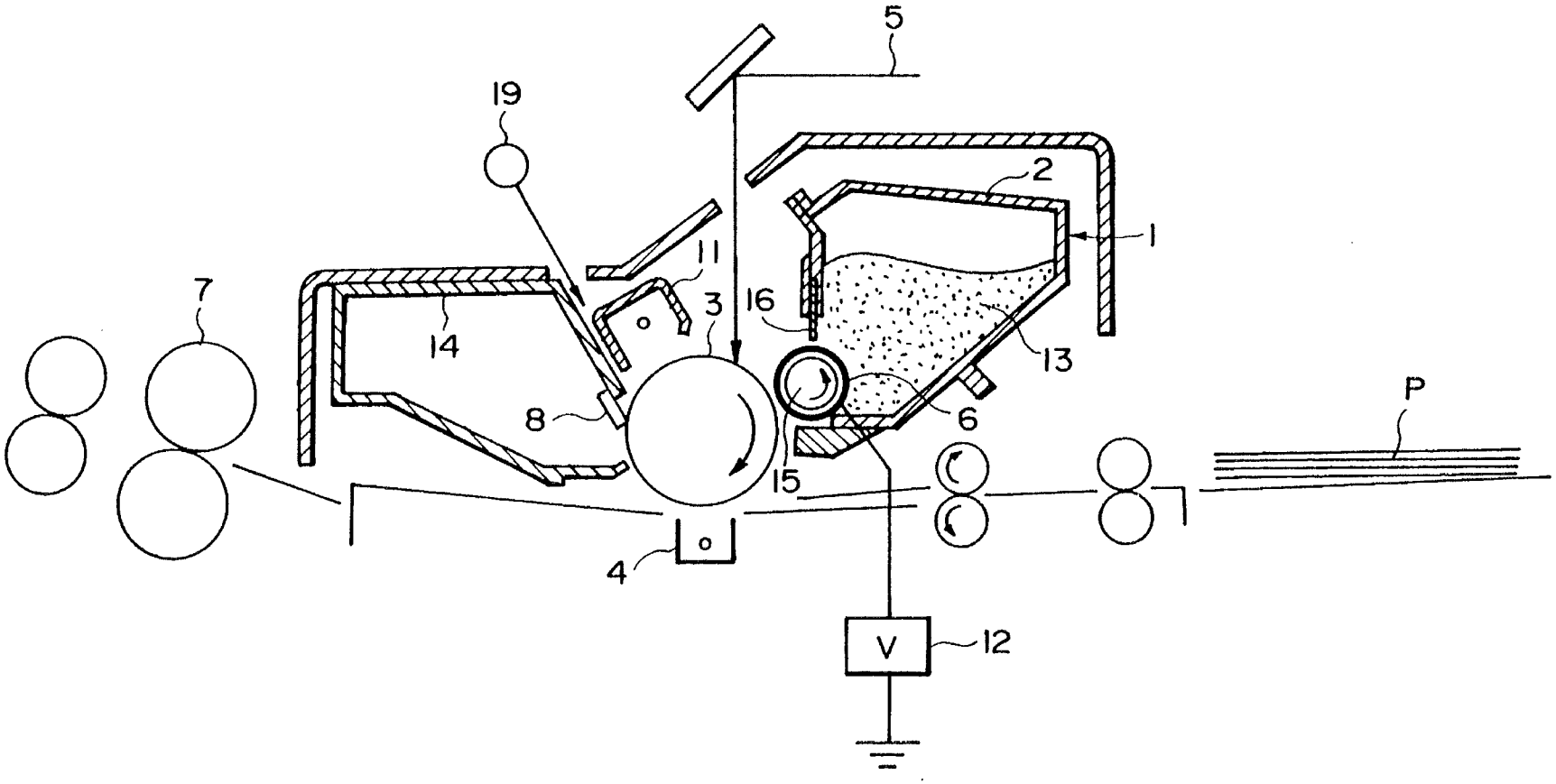
FIG. 2 is a schematic illustration of another embodiment of the image forming apparatus according to the present invention equipped with a magnetic blade.

The apparatus shown in FIG. 2 is different from the apparatus shown in FIG. 1 in that it comprises a magnetic doctor blade 16 for regulating the magnetic developer layer thickness on the developing sleeve 6. The other features are similar to those described with reference to FIG. 1. In FIGS. 1 and 2, the same reference numerals represent identical members.

The magnetic doctor blade 16 comprising, e.g., an iron doctor blade, is disposed in proximity (with a spacing of 50–500 μm) with the developing sleeve 6 surface in opposition to one magnetic pole of the multi-polar permanent magnet, thereby to regulate the developer layer in a small and uniform thickness (30–300 μm), which is smaller than a spacing between the photosensitive drum 3 and the developing sleeve 6 so that the developer layer on the sleeve 6 does not contact the photosensitive drum 3 at the developing position. The rotational speed of the developing sleeve 6 is regulated so that the sleeve surface speed is substantially identical to that of the electrostatic image-bearing surface or close thereto. It is also possible to use a permanent magnet instead of an iron blade as a magnetic doctor blade 16 so as to constitute a counter pole.

A plurality among the above-mentioned structural members inclusive of the electrostatic latent image-bearing member such as the photosensitive drum, the developing apparatus and cleaning means of the image forming apparatus can be integrally combined to form a process cartridge (apparatus unit), which is detachably mountable to a main assembly of the image forming apparatus. For example, at least one of the charging means, the developing apparatus and the cleaning means may be integrally supported together with the photosensitive drum to form a process cartridge which is a single unit detachably mountable to the main assembly by using a guide means, such as a rail, provided to the main assembly. In this instance, it is also possible to incorporate the charging means and/or the developing apparatus in the process cartridge.

Figure 3:
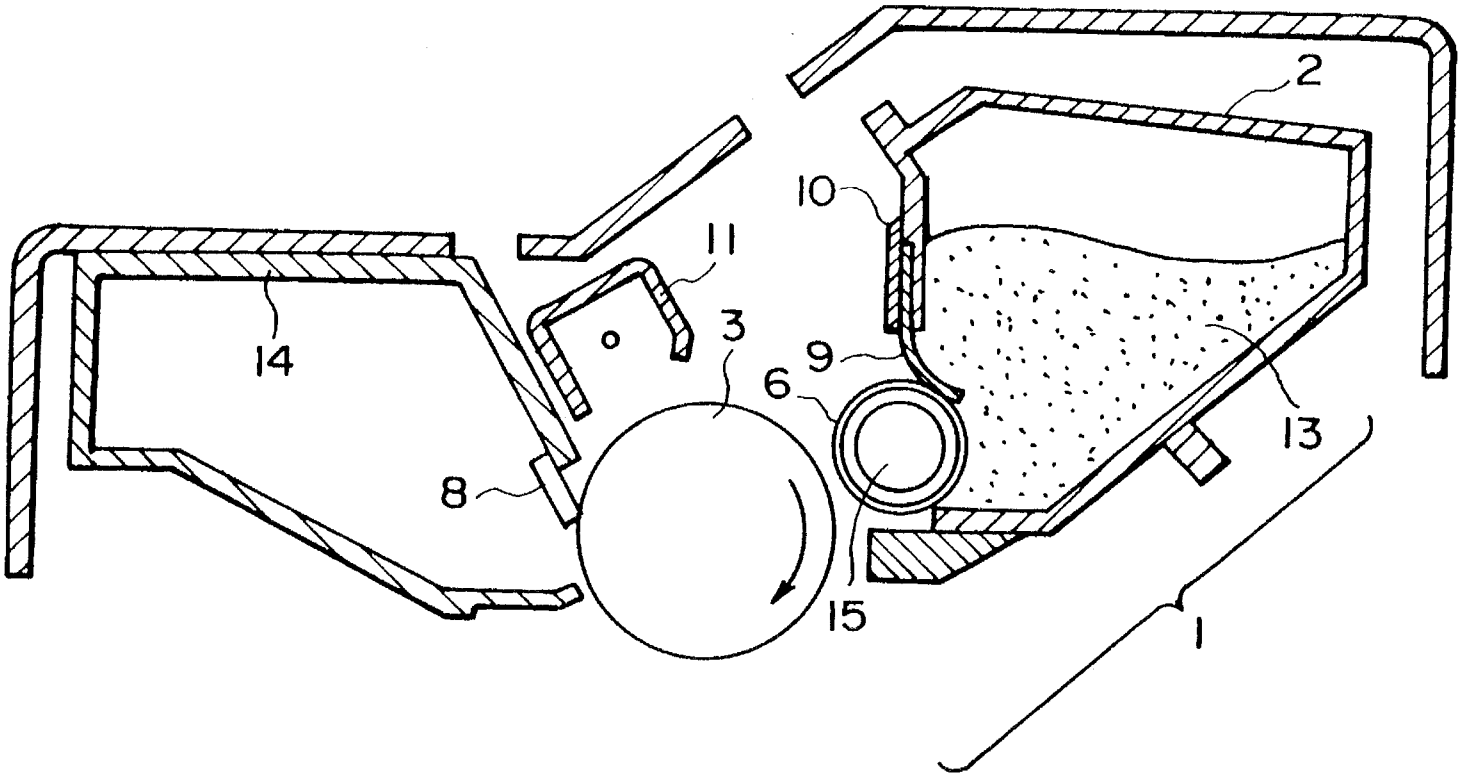
FIG. 3 is a schematic illustration of an embodiment of the process cartridge according to the present invention.

FIG. 3 is an illustration of an embodiment of the process cartridge according to the present invention. In this embodiment, a process cartridge integrally includes a developing apparatus 1, a drum-shaped electrostatic image-bearing member (photosensitive drum) 3, a cleaner 14 and a primary charger 11.

The process cartridge is exchanged with a fresh one when the developer 13 in the developing apparatus 1 is exhausted.

In this embodiment, the developing apparatus 1 contains a one-component type magnetic developer 13. At the time of development, a prescribed electric field should be formed between the photosensitive drum 3 and the developing sleeve 6 so as to suitably perform a developing operation. For this purpose, the spacing between the photosensitive drum 3 and the developing sleeve 6 should be precisely controlled and is adjusted to, e.g., 300 μm as a central value with a tolerance of ±30 μm.

In the process cartridge, the developing apparatus 1 includes a developer container 2 for containing a magnetic developer 13, a developing sleeve 6 for carrying and conveying the magnetic developer 13 in the developer container 2 to a developing region where the sleeve 6 confronts the electrostatic image-bearing member 3, and an elastic blade 9 for regulating the magnetic developer carried on the developing sleeve 6 and conveyed to the developing region at a prescribed thickness to form a uniform thin layer of the developer on the developing sleeve.

The developer-carrying member can have an arbitrary structure but may ordinarily comprise a non-magnetic developing sleeve 6 of a cylindrical rotating member as shown containing a magnet inside thereof. Alternatively, the developer-carrying member can be in the form of a circulating belt. The material thereof may preferably comprise aluminum or SUS (stainless steel).

The elastic blade 9 may be formed as an elastic plate comprising an elastic material, examples of which may include: elastomers, such as urethane rubber, silicon rubber and NBR; elastic metals, such as phosphor bronze and stainless steel; and elastic resins, such as polyethylene terephthalate, and high-density polyethylene. The elastic blade 9 is abutted to the developing sleeve 6 by its own elasticity and fixed to the developer container 2 by a blade-supporting member 10 comprising a rigid material such as iron. It is preferred that the elastic blade 9 is abutted at a linear pressure of 5–80 g/cm to the developing sleeve 6 in a counter direction with respect to the rotation direction of the developing sleeve.

Hereinbelow, the present invention will be described with reference to Resin Production Examples and Examples, to which the present invention should not be however construed as restricted.

[Resin Production Example 1]

| | |
|---|---|
| Polyoxypropylene(2,2)-2,2-bis(4-hydroxyphenyl)propane | 150 wt. parts |
| Polyoxyethylene(2)-2,2-bis(4-hydroxyphenyl)propane | 100 wt. parts |
| Terephthalic acid | 50 wt. parts |
| Succinic acid | 40 wt. parts |
| 1,2,4-Benzenetricarboxylic anhydride | 50 wt. parts |

The above ingredients were placed in a 5 liter-four-necked flask equipped with a reflux cooler, a water separator, an $N_2$ gas supply pipe, a thermometer and a stirrer and subjected to condensation polymerization at 230° C. while introduce $N_2$ gas into the flask, thereby to obtain a polyester resin A having Mn=5800, Mw=28,000, Tg=62° C., an acid value of 18 and an OH value of 24.

Resin Production Example 2

The above Resin Production Example 1 was repeated except for changing the amount of the succinic acid to 50 wt. parts, thereby to obtain a polyester resin B having an acid value of 36, an OH value of 22, Tg=63° C., Mn=6000, and Mw=24000.

Resin Production Example 3

Resin Production Example 1 was repeated except for changing the amount of the succinic acid to 30 wt. parts and the amount of 1,2,4-benzenetricarboxylic anhydride to 20 wt. parts, thereby to obtain a polyester resin C having an acid value of 11 and an OH value of 30.

| [Resin Production Example 4] | |
|---|---|
| Polyoxypropylene(2,2)-2,2-bis(4-hydroxyphenyl)propane | 150 wt. parts |
| Polyoxyethylene(2)-2,2-bis(4-hydroxyphenyl)propane | 70 wt. parts |
| Isophthalic acid | 50 wt. parts |
| n-Dodecylsuccinic acid | 30 wt. parts |
| Terephthalic acid | 30 wt. parts |
| 1,2,4-Benzenetricarboxylic anhydride | 50 wt. parts |

The above ingredients were subjected to condensation polymerization in the same manner as in Resin Production Example 1, thereby to obtain a polyester resin D having Mn=4500, Mw=24,000, Tg=58° C., an acid value of 43 and an OH value of 15.

Resin Production Example 5

The above Resin Production Example 4 was repeated except for changing the amount of the terephthalic acid to 60 wt. parts, thereby to obtain a polyester resin E having an acid value of 52, an OH value of 10, Tg=67° C., Mn=1000, and Mw=30000.

Resin Production Example 6

Resin Production Example 1 was repeated except for changing the amount of the terephthalic acid to 10 wt. parts and the amount of 1,2,4-benzenetricarboxylic anhydride to 10 wt. parts, thereby to obtain a polyester resin F having an acid value of 4, an OH value of 43, Tg=50° C., Mn=3000, and Mw=17,000.

| [Resin Production Example 7] | |
|---|---|
| Styrene | 70 wt. part(s) |
| n-Butyl acrylate | 24.5 wt. part(s) |
| Monobutyl maleate | 5 wt. part(s) |
| Divinylbenzene | 0.5 wt. part(s) |
| Benzoyl peroxide | 1.3 wt. part(s) |

To a mixture liquid comprising the above ingredients, 170 wt. parts of water containing 0.12 wt. part of partially saponified polyvinyl alcohol was added, and the system was stirred vigorously to form a suspension liquid. The suspension liquid was added to a reaction vessel containing 300 wt. parts of water and aerated with nitrogens and was subjected to suspension polymerization at 80° C. for 8 hours.

After the reaction,the product was washed with water, dewatered and dried to obtain a vinyl resin G, which showed Mw=180,000, Mn=9000, an acid value of 19 mgKOH/g, an OH value of 0 and Tg=59° C.

| [Resin Production Example 8] | |
|---|---|
| Styrene | 70 wt. part(s) |
| n-Butyl acrylate | 25 wt. part(s) |
| Monobutyl maleate | 15 wt. part(s) |
| Divinylbenzene | 0.5 wt. part(s) |
| Benzoyl peroxide | 1.2 wt. part(s) |

To a mixture liquid comprising the above ingredients, 170 wt. parts of water containing 0.12 wt. part of partially saponified polyvinyl alcohol was added, and the system was stirred vigorously to form a suspension liquid. The suspension liquid was added to a reaction vessel containing 300 wt. parts of water and aerated with nitrogen, and was subjected to suspension polymerization at 80° C. for 8 hours.

After the reaction,the product was washed with water, dewatered and dried to obtain a vinyl resin H, which showed Mw=130,000, Mn=8000, an acid value of 40 mgKOH/g, an OH value of 0 and Tg=57° C.

| [Resin Production Example 9] | |
|---|---|
| Styrene | 72 wt. part(s) |
| n-Butyl acrylate | 22 wt. part(s) |
| Monobutyl maleate | 10 wt. part(s) |
| Divinylbenzene | 0.3 wt. part(s) |
| Benzoyl peroxide | 1.2 wt. part(s) |

To a mixture liquid comprising the above ingredients, 170 wt. parts of water containing 0.12 wt. part of partially saponified polyvinyl alcohol was added, and the system was stirred vigorously to form a suspension liquid. The suspension liquid was added to a reaction vessel containing 300 wt. parts of water and aerated with nitrogen, and was subjected to suspension polymerization at 80° C. for 8 hours.

After the reaction,the product was washed with water, dewatered and dried to obtain a vinyl resin I, which showed Mw=115,000, Mn=8500, an acid value of 33 mgKOH/g, an OH value of 0 and Tg=62° C.

| [Resin Production Example 10] | |
|---|---|
| Styrene | 70 wt. part(s) |
| n-Butyl acrylate | 24.5 wt. part(s) |
| Monobutyl maleate | 2 wt. part(s) |
| Divinylbenzene | 0.4 wt. part(s) |
| Benzoyl peroxide | 1.2 wt. part(s) |

To a mixture liquid comprising the above ingredients, 170 wt. parts of water containing 0.12 wt. part of partially saponified polyvinyl alcohol was added, and the system was stirred vigorously to form a suspension liquid. The suspension liquid was added to a reaction vessel containing 300 wt. parts of water and aerated with nitrogen, and was subjected to suspension polymerization at 80° C. for 8 hours.

After the reaction,the product was washed with water, dewatered and dried to obtain a vinyl resin J, which showed Mw=183,000, Mn=10500, an acid value of 6 mgKOH/g, an OH value of 0 and Tg=61° C.

| [Resin Production Example 11] | |
|---|---|
| Styrene | 80 wt. part(s) |
| n-Butyl acrylate | 20 wt. part(s) |
| Monobutyl maleate | 15 wt. part(s) |
| Divinylbenzene | 0.5 wt. part(s) |
| Benzoyl peroxide | 1.2 wt. part(s) |
| Acrylic acid | 5 wt. part(s) |

To a mixture liquid comprising the above ingredients, 170 wt. parts of water containing 0.12 wt. part of partially saponified polyvinyl alcohol was added, and the system was stirred vigorously to form a suspension liquid. The suspension liquid was added to a reaction vessel containing 300 wt. parts of water and aerated with nitrogen, and was subjected to suspension polymerization at 80° C. for 8 hours.

After the reaction,the product was washed with water, dewatered and dried to obtain a vinyl resin K, which showed Mw=210,000, Mn=12000, an acid value of 5.5 mgKOH/g, and an OH value of 0.

| [Resin Production Example 12] | |
|---|---|
| Styrene | 75 wt. part(s) |
| n-Butyl acrylate | 25 wt. part(s) |
| Divinylbenzene | 0.5 wt. part(s) |
| Benzoyl peroxide | 1.2 wt. part(s) |

To a mixture liquid comprising the above ingredients, 170 wt. parts of water containing 0.12 wt. part of partially saponified polyvinyl alcohol was added, and the system was stirred vigorously to form a suspension liquid. The suspension liquid was added to a reaction vessel containing 300 wt. parts of water and aerated with nitrogen, and was subjected to suspension polymerization at 80° C. for 8 hours.

After the reaction,the product was washed with water, dewatered and dried to obtain a vinyl resin L, which showed Mw=170,000, Mn=10000, an acid value of 0.5 mgKOH/g, and an OH value of 0.

EXAMPLE 1

| | |
|---|---|
| Polyester resin A | 100 wt. parts |
| Magnetic iron oxide (Dav. = 0.2 μm, Hc = 120 Oe, σs = 65 emu/g, σr = 7 emu/g) | 90 wt. parts |
| Iron Complex (1) | 2 wt. parts |
| Low-molecular weight polypropylene | 3 wt. parts |

The above mixture was melt-kneaded through a twin-screw extruder heated at 130° C. After cooling the kneaded product was crushed by a hammer mill, pulverized by a jet mill and classified by a fixed-wall pneumatic classifier to obtain classified powder, which was then classified by a multi-division classifier utilizing Coanda effect ("Elbow Jet Classifier" available from Nittetsu Kogyo K. K.) to remove a fine powder fraction containing about 70% by number of particles having a particle size (diameter) of 4 μm or smaller and a coarse powder fraction containing about 20 mol. % of particles having a particle size of 12.7 μm or larger simultaneously to recover a medium powder fraction (black fine powder) having a weight-average particle size ($D_4$) of 7.0 μm as a negatively chargeable insulating magnetic toner (1).

The magnetic toner was subjected to measurement of particle size distribution by means of Coulter counter Ta-II equipped with a 100 μm-dia. aperture. The measured particle size distribution data are summarized in Table 1 appearing hereinafter.

The localization factors of the azo-type iron complex in the fine and coarse powder fractions were $OD_F/OD_M$=1.012 and $OD_C/OD_M$=0.998.

100 wt. parts of the magnetic toner (1) and 1.0 wt. part of hydrophobic silica surface-treated with hexamethyldisilazane were blended in a Henschel mixer to obtain a developer No. 1.

The developer No. 1 was charged in a commercially available copying machine ("NP=9800" available from Canon K. K., equipped with an amorphous silicon photosensitive drum suitable for bearing a positively charged analog electrostatic image to be normally developed with a negatively charged developer) and subjected to $2\times10^5$ sheets of image formation in a normal temperature/low humidity (N/L) environment (23.5° C./5% RH), and then to $1\times10^5$ sheets of image formation in a high temperature/high humidity (H/H) environment (32.5° C./90% RH).

The results of the image formation tests are summarized in Table 2 appearing hereinafter.

As shown in Table 2, high quality images having a high image density, free from fog and showing sufficiently high resolution were obtained in both the low humidity and high humidity environments.

Further, the developer in the copying machine was left standing for 1 month in the high temperature/high humidity environment and again subjected to image formation in the environment. The results are also shown in Table 2.

As shown in FIG. 2, the developer No. 1 provided a high image density even after the long term standing in the high humidity environment which density was not substantially different from the value before the standing.

EXAMPLE 2

A magnetic toner (2) having a weight-average particle size ($D_4$) of 5.4 μm was obtained in the same manner as in Example 1 except that Polyester resin A was replaced by Polyester resin B. Then, a developer No. 2 was obtained by blending the magnetic toner (2) with the hydrophobic silica in the same manner as in Example 1.

The developer No. 2 thus obtained was subjected to image formation tests in the same manner as in Example 1, whereby good results as shown in Table 2 were obtained.

EXAMPLE 3

A magnetic toner (3) having a weight-average particle size ($D_4$) of 8.7 μm was obtained in the same manner as in Example 1 except that Polyester resin A was replaced by Polyester resin C. Then, a developer No. 3 was obtained by blending the magnetic toner (3) with the hydrophobic silica in the same manner as in Example 1.

The developer No. 3 thus obtained was subjected to image formation tests in the same manner as in Example 1, whereby good results as shown in Table 2 were obtained.

EXAMPLE 4

A magnetic toner (4) having a weight-average particle size ($D_4$) of 7.8 μm was obtained in the same manner as in Example 1 except that Polyester resin A was replaced by Polyester resin D and Iron Complex (1) was replaced by Iron Complex (2). Then, a developer No. 4 was obtained by blending the magnetic toner (4) with the hydrophobic silica in the same manner as in Example 1.

The developer No. 4 thus obtained was subjected to image formation tests in the same manner as in Example 1, whereby good results as shown in Table 2 were obtained.

EXAMPLE 5

A magnetic Toner (5) having a weight-average particle size ($D_4$) of 5.8 μm was obtained in the same manner as in Example 1 except that Polyester resin A was replaced by Vinyl resin G and Iron Complex (1) was replaced by Iron Complex (3). Then, a developer No. 5 was obtained by blending the magnetic toner (5) with the hydrophobic silica in the same manner as in Example 1.

The developer No. 5 thus obtained was subjected to image formation tests in the same manner as in Example 1, whereby good results as shown in Table 2 were obtained.

EXAMPLE 6

A magnetic toner (6) having a weight-average particle size ($D_4$) of 6.5 μm was obtained in the same manner as in Example 1 except that Polyester resin A was replaced by Vinyl resin H and Iron Complex (1) was replaced by Iron Complex (4). Then, a developer No. 6 was obtained by blending the magnetic toner (6) with the hydrophobic silica in the same manner as in Example 1.

The developer No. 6 thus obtained was subjected to image formation tests in the same manner as in Example 1, whereby good results as shown in Table 2 were obtained.

EXAMPLE 7

A magnetic toner (7) having a weight-average particle size ($D_4$) of 7.5 μm was obtained in the same manner as in Example 1 except that Polyester resin A was replaced by Vinyl resin I. Then, a developer No. 7 was obtained by blending the magnetic toner (7) with the hydrophobic silica in the same manner as in Example 1.

The developer No. 7 thus obtained was subjected to image formation tests in the same manner as in Example 1, whereby good results as shown in Table 2 were obtained.

EXAMPLE 8

A magnetic toner (8) having a weight-average particle size ($D_4$) of 8.5 μm was obtained in the same manner as in Example 1 except that Polyester resin A was replaced by Vinyl resin J and Iron Complex (1) was replaced by Iron Complex (5). Then, a developer No. 8 was obtained by blending the magnetic toner (8) with the hydrophobic silica in the same manner as in Example 1.

The developer No. 8 thus obtained was subjected to image formation tests in the same manner as in Example 1, whereby good results as shown in Table 2 were obtained.

EXAMPLE 9

| | |
|---|---|
| Fine powder fraction after classification in Example 1 | 90 wt. parts |
| Coarse powder fraction after classification in Example 1 | 15 wt. parts |
| Polyester resin A | 100 wt. parts |

-continued

| | |
|---|---|
| Magnetic iron oxide (Dav. = 0.2 μm, Hc = 120 Oe, σs = 65 emu/g, σr = 7 emu/g) | 90 wt. parts |
| Iron Complex (1) | 2 wt. parts |
| Low-molecular weight polypropylene | 3 wt. parts |

The above mixture was melt-kneaded through a twin-screw extruder heated at 130° C., followed by treatments in the same manner as in Example 1 to obtain a magnetic toner (9) having a weight-average particle size ($D_4$) of 7.2 μm. Then, a developer No. 9 was obtained by blending the magnetic toner (9) with the hydrophobic silica in the same manner as in Example 1.

The developer No. 9 thus obtained was subjected to image formation tests in the same manner as in Example 1, whereby good results as shown in Table 2 were obtained.

EXAMPLE 10

| | |
|---|---|
| Fine powder fraction after classification in Example 7 (containing ca. 69% by number of particles of ≦4 μm) | 90 wt. parts |
| Coarse powder fraction after classification in Example 7 (containing ca. 19% by volume of particles of ≧12.8 μm) | 15 wt. parts |
| Vinyl resin I | 100 wt. parts |
| Magnetic iron oxide | 90 wt. parts |
| Iron Complex (1) | 2 wt. parts |
| Low-molecular weight polypropylene | 3 wt. parts |

The above mixture was melt-kneaded through a twin-screw extruder heated at 130° C., followed by treatments in the same manner as in Example 1 to obtain a magnetic toner (10) having a weight-average particle size ($D_4$) of 7.4 μm. Then, a developer No. 10 was obtained by blending the magnetic toner (10) with the hydrophobic silica in the same manner as in Example 1.

The developer No. 10 thus obtained was subjected to image formation tests in the same manner as in Example 1, whereby good results as shown in Table 2 similar to those in Example 7 were obtained.

EXAMPLE 11

A magnetic toner (11) having a weight-average particle size ($D_4$) of 4.5 μm was obtained in the same manner as in Example 1 except that Iron Complex (1) was replaced by Iron Complex (6). Then, a developer No. 11 was obtained by blending the magnetic toner (11) with the hydrophobic silica in the same manner as in Example 1.

The developer No. 11 thus obtained was subjected to image formation tests in the same manner as in Example 1, whereby good results as shown in Table 2 were obtained.

EXAMPLE 12

A magnetic toner (12) having a weight-average particle size ($D_4$) of 4.2 μm was obtained in the same manner as in Example 1 except that Iron Complex (1) was replaced by Iron Complex (2) and the conditions for the pulverization and classification during the toner production were changed. Then, a developer No. 12 was obtained by blending the magnetic toner (12) with the hydrophobic silica in the same manner as in Example 1.

The developer No. 12 thus obtained was subjected to image formation tests in the same manner as in Example 1, whereby results as shown in Table 2 were obtained.

EXAMPLE 13

A magnetic toner (13) having a weight-average particle size ($D_4$) of 8.9 μm was obtained in the same manner as in Example 1 except that Iron Complex (1) was replaced by Iron Complex (2) and the conditions for the pulverization and classification during the toner production were changed. Then, a developer No. 13 was obtained by blending the magnetic toner (13) with the hydrophobic silica in the same manner as in Example 1.

The developer No. 13 thus obtained was subjected to image formation tests in the same manner as in Example 1, whereby results as shown in Table 2 were obtained.

COMPARATIVE EXAMPLE 1

A comparative magnetic toner (1) having a weight-average particle size ($D_4$) of 7.2 μm was obtained in the same manner as in Example 1 except that Polyester resin A was replaced by Polyester resin F (acid value=4). Then, a comparative developer No. 1 was obtained by blending the comparative magnetic toner (1) with the hydrophobic silica in the same manner as in Example 1.

The comparative developer No. 1 thus obtained was subjected to image formation tests in the same manner as in Example 1. As a result, the resultant images showed a remarkably low image density, were accompanied with noticeable fog and thus were practically unacceptable in a normal temperature/low humidity environment, Accordingly, the image forming test in a high temperature/high humidity environment after 20 sheets of image formation was not performed.

COMPARATIVE EXAMPLE 2

A comparative magnetic toner (2) having a weight average particle size ($D_4$) of 8.3 μm was obtained in the same manner as in Example 1 except that Polyester resin A was replaced by Vinyl resin L (acid value=0.5). Then, a comparative developer No. 2 was obtained by blending the comparative magnetic toner (2) with the hydrophobic silica in the same manner as in Example 1.

The comparative developer No. 2 thus obtained was subjected to image formation tests in the same manner as in Example 1. As a result, the resultant images showed a remarkably low image density, were accompanied with noticeable fog and thus were practically unacceptable in a normal temperature/low humidity environment similarly as in Comparative Example 1. Accordingly, the image forming test in a high temperature/high humidity environment after 20 sheets of image formation was not performed.

COMPARATIVE EXAMPLE 3

A comparative magnetic toner (3) having a weight-average particle size ($D_4$) of 8.4 μm and containing 20% by volume of particles of ≦12.7 μm was obtained in the same manner as in Example 1 except that Polyester resin A was replaced by Vinyl resin K. Then, a comparative developer No. 3 was obtained by blending the comparative magnetic toner (3) with the hydrophobic silica in the same manner as in Example 1. The comparative developer No. 3 thus obtained was subjected to image formation tests in the same manner as in Example 1. As a result, in the normal temperature/low humidity environment, the image density was somewhat lowered and the resolution was lowered on continuation of the image formation as shown in Table 2. In the high temperature/high humidity environment, the image density was remarkably lowered. As a result of the standing test after the $3\times10^5$ sheets of image formation, practicality satisfactory images could not be obtained.

COMPARATIVE EXAMPLE 4

A comparative magnetic toner (4) having a weight-average particle size of 11.5 μm was obtained in the same manner as in Example 1 except for changing the pulverization condition. Then, a comparative developer No. 4 was prepared by blending the comparative magnetic toner (4) with the hydrophobic silica in the same manner as in Example 1.

The comparative developer No. 4 was subjected to image formation tests in the same manner as in Example 1. As shown in Table 2, the resultant images were accompanied with noticeable fog and the resolution was remarkably lowered on continuation of the image formation in the normal temperature/low humidity environment, and a resolution failure was caused in the high temperature/high humidity environment.

COMPARATIVE EXAMPLE 5

A comparative magnetic toner (5) having a weight-average particle size of 4.8 μm was obtained in the same manner as in Example 1 except that Polyester resin A was replaced by Polyester resin E (acid value=52) and Iron Complex (1) was replaced by 3 wt. parts of 3,5-di-tert-butylsalicylic acid aluminum complex. The degree of localization of the aluminum complex in the fine and coarse powder fractions was not examined since the aluminum complex showed no absorption at λ=480 nm. Then, a comparative developer No. 5 was obtained by blending the comparative magnetic toner (5) with the hydrophobic silica in the same manner as in Example 1.

The comparative developer No. 5 thus obtained was subjected to image formation tests in the same manner as in Example 1. As shown in Table 2, the resultant images showed a low resolution in spite of the small particle size of the toner, caused a remarkable decrease in image density and were accompanied with noticeable fog, thus being practically unsatisfactory in the normal temperature/low humidity environment. Accordingly, the test in the high temperature/high humidity environment after $2\times10^5$ sheets of the image formation was not performed.

COMPARATIVE EXAMPLE 6

A comparative magnetic toner (6) having a weight average particle size of 8.3 μm was obtained in the same manner as in Example 1 except that Iron Complex (1) was replaced by a chromium complex represented by the following formula:

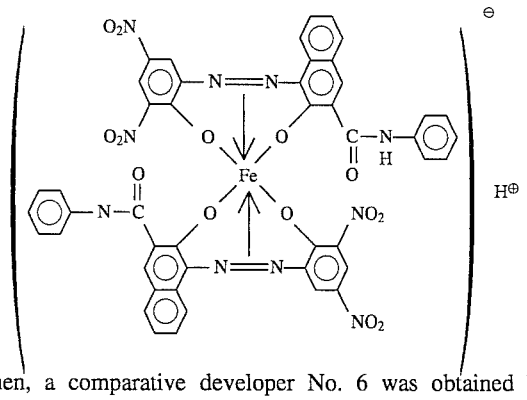

Then, a comparative developer No. 6 was obtained by blending the comparative magnetic toner (6) with the hydrophobic silica in the same manner as in Example 1.

The comparative developer No. 6 thus obtained was subjected to image formation tests in the same manner as in Example 1. As shown in table 2, the resultant images in the normal temperature/low humidity environment were practically acceptable level but the images formed after the standing for 1 month in the high humidity environment caused a remarkable decrease in image density.

The fine powder fraction and the coarse powder fraction removed in the classification for producing the comparative magnetic toner (6) showed the following localization factors of the chromium complex: $OD_F/OD_M$=1.213 and $OD_C/OD_M$=0,843.

COMPARATIVE EXAMPLE 7

| | |
|---|---|
| Fine powder fraction after classification in Comparative Example 6 (containing ca 65% by number of particles of ≦4 μm) | 90 wt. parts |
| Coarse powder fraction after classification in Comparative Example 7 (containing ca 21% by volume of particles of ≧12.7 μm) | 15 wt. parts |
| Polyester resin A | 100 wt. parts |
| Magnetic iron oxide | 90 wt. parts |

-continued

| | |
|---|---|
| Chromium complex | 2 wt. parts |
| Low-molecular weight polypropylene | 3 wt. parts |

The above mixture was melt-kneaded through a twin-screw extruder heated at 130° C., followed by treatments in the same manner as in Example 1 to obtain a comparative magnetic toner (7) having a weight-average particle size ($D_4$) of 8.3 μm. Then, a comparative developer No. 7 was obtained by blending the magnetic toner (7) with the hydrophobic silica in the same manner as in Example 1.

The comparative developer No. 7 thus obtained was subjected to image formation tests in the same manner as in Example 1. As shown in Table 2, in the normal temperature/low humidity environment, the resultant images were good in the initial stage, but showed a remarkable decrease in image density and were accompanied with remarkable fog on continuation of the image formation. Accordingly, the image formation test was terminated after the image formation on $2\times10^5$ sheets.

The fine powder fraction and the coarse powder fraction removed in the classification for producing the comparative magnetic toner (7) showed the following localization factors of the chromium complex: $OD_F/OD_M$=1.430 and $OD_C/OD_M$=0.793. Thus, the localization was more remarkable than in Comparative Example 6.

The results of the above Examples and Comparative Examples are summarized in Tables 1 and 2 below.

In Table 1, N % means % by number, Vol. % means % by volume, $D_4$ means weight-average particle size.

TABLE 1

| Magnetic toner | Particle size characteristics: N % of ≦5 μm | Vol. % of ≧12.7 μm | N % of 6.35–10.08 μm | $D_4$ (μm) | N %/Vol. % of ≧5 μm | Range for −0.05N + k | Acid value of resin | Localization factor: $OD_F/OD_M$ | $OD_C/OD_M$ |
|---|---|---|---|---|---|---|---|---|---|
| 1 | 37 | 0.1 | 37 | 7.0 | 2.6 | 1.15–5.65 | 18 | 1.012 | 0.998 |
| 2 | 57 | 0 | 20 | 5.4 | 2.7 | 0.15–4.65 | 36 | 1.009 | 0.997 |
| 3 | 16 | 0.6 | 53 | 8.7 | 5.9 | 2.20–6.70 | 11 | 1.029 | 0.985 |
| 4 | 43 | 0.2 | 40 | 7.8 | 3.0 | 0.85–5.35 | 43 | 1.017 | 0.989 |
| 5 | 53 | 0 | 12 | 5.8 | 3.6 | 0.35–4.85 | 19 | 1.019 | 0.989 |
| 6 | 14 | 0.3 | 48 | 6.5 | 2.3 | 2.30–6.80 | 40 | 1.010 | 0.995 |
| 7 | 47 | 0.2 | 37 | 7.5 | 3.1 | 0.65–5.15 | 33 | 1.015 | 0.990 |
| 8 | 9 | 1.0 | 63 | 8.5 | 3.8 | 2.55–7.05 | 6 | 1.031 | 0.975 |
| 9 | 36 | 0.1 | 36 | 7.2 | 2.6 | 1.20–5.70 | 18 | 1.011 | 0.995 |
| 10 | 48 | 0.2 | 36 | 7.4 | 3.0 | 0.60–5.10 | 19 | 1.015 | 0.993 |
| 11 | 72 | 0 | 2.0 | 4.5 | 2.2 | −0.60–3.90 | 18 | 1.033 | 0.978 |
| 12 | 80 | 0 | 3 | 4.2 | 1.8 | −1.00–3.50 | 18 | 1.037 | 0.963 |
| 13 | 10 | 1.5 | 71 | 8.9 | 2.4 | 3.50–7.00 | 18 | 1.024 | 0.985 |
| Comp. 1 | 36 | 0.2 | 35 | 7.2 | 4.0 | 1.20–5.70 | 4 | 1.033 | 0.970 |
| Comp. 2 | 25 | 1.2 | 44 | 8.3 | 3.7 | 1.75–6.25 | 0.5 | 1.041 | 0.962 |
| Comp. 3 | 27 | 0.9 | 43 | 8.4 | 4.3 | 1.65–6.15 | 55 | 1.011 | 0.987 |
| Comp. 4 | 8 | 20 | 63 | 11.5 | 20.0 | 2.60–7.10 | 27 | 1.019 | 0.979 |

TABLE 1-continued

| Magnetic toner | Particle size characteristics: N % of ≦5 μm | Vol. % of ≧12.7 μm | N % of 6.35–10.08 μm | $D_4$ (μm) | N %/Vol. % of ≧5 μm | Range for −0.05N + k | Acid value of resin | Localization factor: $OD_F/OD_M$ | $OD_C/OD_M$ |
|---|---|---|---|---|---|---|---|---|---|
| Comp. 5 | 67 | 0 | 7 | 4.8 | 7.2 | −0.35–4.15 | 52 | — | — |
| Comp. 6 | 24 | 1.5 | 44 | 8.3 | 4.7 | 1.80–6.30 | 18 | 1.213 | 0.843 |
| Comp. 7 | 26 | 0.8 | 42 | 8.3 | 4.6 | 1.30–6.20 | 18 | 1.430 | 0.793 |

TABLE 2

| Ex. or Comp.Ex. | N/L (23.5°C./5% RH) Initial: I.D.*3 | Fog*1 | Res.*2 (lines/mm) L/T | After 2 × $10^5$ sheets: I.D. | Fog | Res. lines/mm L/T | H/H (32.5°C./90% RH) After 3 × $10^5$ sheets ($10^5$ sheets in H/H): I.D. | Fog | Res. (lines/mm) L/T | After 1 M. in H/H: I.D. | Fog |
|---|---|---|---|---|---|---|---|---|---|---|---|
| Ex. 1 | 1.45 | ⊙ | 8.0/8.0 | 1.42 | ⊙ | 8.0/8.0 | 1.36 | ⊙ | 8.0/8.0 | 1.34 | ⊙ |
| 2 | 1.43 | ⊙ | 9.0/9.0 | 1.41 | ⊙ | 9.0/9.0 | 1.33 | ⊙ | 9.0/9.0 | 1.33 | ⊙ |
| 3 | 1.46 | ⊙ | 8.0/8.0 | 1.41 | ⊙ | 7.1/7.1 | 1.34 | ⊙ | 7.1/6.3 | 1.31 | ⊙ |
| 4 | 1.47 | ⊙ | 8.0/8.0 | 1.45 | ⊙ | 8.0/7.1 | 1.30 | ⊙ | 7.1/7.1 | 1.30 | ⊙ |
| 5 | 1.34 | ⊙ | 9.0/8.0 | 1.36 | ○ | 9.0/8.0 | 1.33 | ⊙ | 8.0/8.0 | 1.28 | ⊙ |
| 6 | 1.36 | ⊙ | 8.0/8.0 | 1.35 | ○ | 7.1/6.3 | 1.28 | ⊙ | 8.0/7.1 | 1.27 | ⊙ |
| 7 | 1.33 | ⊙ | 8.0/8.0 | 1.35 | ⊙ | 8.0/8.0 | 1.31 | ⊙ | 8.0/8.0 | 1.29 | ⊙ |
| 8 | 1.31 | ⊙ | 7.1/7.1 | 1.30 | ○Δ | 6.3/6.3 | 1.28 | ○Δ | 6.3/5.6 | 1.27 | ○ |
| 9 | 1.44 | ⊙ | 8.0/8.0 | 1.40 | ⊙ | 8.0/8.0 | 1.34 | ○ | 8.0/8.0 | 1.33 | ⊙ |
| 10 | 1.34 | ⊙ | 8.0/8.0 | 1.33 | ⊙ | 8.0/8.0 | 1.32 | ⊙ | 3.0/3.0 | 1.27 | ⊙ |
| 11 | 1.38 | ⊙ | 10.0/9.0 | 1.37 | ○Δ | 9.0/8.0 | 1.32 | ○ | 9.0/8.0 | 1.31 | ○ |
| 12 | 1.37 | ○ | 10.0/9.0 | 1.32 | ○Δ | 7.1/7.1 | 1.28 | ○ | 7.1/6.3 | 1.25 | ○Δ |
| 13 | 1.35 | ⊙ | 8.0/8.0 | 1.31 | ○ | 6.3/5.6 | 1.26 | ○ | 6.3/5.6 | 1.27 | ○ |
| Comp. 1 | 1.31 | ○ | 8.0/8.0 | 0.94 | x | 4.0/3.6 | — | — | — | — | — |
| 1 | | | | | | | | | | | |
| 2 | 1.27 | ○ | 7.1/7.1 | 0.97 | x | 4.0/3.6 | — | — | — | — | — |
| Comp. Ex. 3 | 1.28 | ○ | 7.1/7.1 | 1.20 | ○ | 4.0/3.6 | 1.04 | ○ | 3.6/3.6 | 0.91 | ○ |
| 4 | 1.32 | ○ | 4.0/4.0 | 1.24 | Δ | 2.0/2.0 | 1.10 | ○ | Failed | 1.08 | ○ |
| 5 | 1.20 | ○ | 3.6/4.0 | 0.83 | x | 2.0/2.0 | — | — | — | — | — |
| 6 | 1.28 | ○ | 7.1/7.1 | 1.27 | ○Δ | 4.0/4.0 | 1.19 | ○ | 3.6/3.6 | 0.95 | ○ |
| 7 | 1.28 | ○ | 7.1/7.1 | 1.10 | x | 2.0/2.0 | — | — | — | — | — |

*1: The evaluation of fog was performed in the following manner.

The whiteness of a white background part of a copied image on a plain paper sheet was measured, and a lowering in whiteness compared with the whiteness of the plain paper sheet per se before the copying was obtained as fog (%). The results are indicated in Table 2 according to the following standards:

⊙. . . below 1.2% (very good)

○. . . 1.2%—below 1.8% (good)

○Δ. . . 1.8%—below 2.5% (practically acceptable)

Δ. . . 2.5%—below 4.0% (somewhat problematic)

x . . . ≧4.0% (practically unacceptable)

*2: The resolution was evaluated in the following manners. Twelve line images each comprising 5 thin lines having an equal width and an equal spacing were formed with different pitches of 2.8 lines, 3.2 lines, 3.6 lines, 4.0 lines, 4.5 lines, 5.0 lines, 5.6 lines, 6.3 lines, 7.1 lines, 8.0 lines, 9.0 lines and 10.0 lines, respectively per mm, as an original. The original was reproduced under proper copying conditions to form a copy on a plain paper sheet, which was examined through a magnifying glass as to how many lines (/mm) could be observed to be clearly separated. A higher number represents a higher resolution. The resolution was evaluated for each sample copy with respect to both longitudinally extending lines (L) and transversely extending lines (T).

*3: I.D. denotes "image density".

EXAMPLE 14

The process cartridge of a commercially available laser beam printer ("LBP-8II" available from Canon K. K.) was re-modelled as shown in FIG. 3 to include a urethane rubber-made elastic blade, which was abutted against an aluminum-made developing sleeve at a contact pressure of 30 g/cm.

The developer No. 1 prepared in Example 1 was incorporated in a developer container 2 as a magnetic developer 13 and was used for image formation. An electrostatic image for reversal development was formed on an OPC photosensitive drum 3 at a primary charge voltage of −700 volts. The developing sleeve 6 containing a magnet inside thereof was disposed with a spacing of 300 μm from the photosensitive drum 3 so that a developer layer formed thereon was free of contact with the photosensitive drum at the developing position. The electrostatic image was developed by reversal development while applying an AC bias (f=1800 Hz, Vpp=1,600 volts) and a DC bias ($V_{DC}$=−500 volts) to the developing sleeve, thereby to form a magnetic toner image on the photosensitive drum. The toner image was then transferred onto a plain paper sheet at a positive transfer potential and then fixed thereto by passing the paper sheet through a hot pressure roller fixing device.

High quality images were continually formed until the developer in the developer container 2 was consumed.

As described above, the toner for developing electrostatic images according to the present invention can continually provide high-quality images at a high resolution and a high image density for a long period under severe conditions of low humidity or high humidity. Further, the developer is free from localization of the charge control agent in the binder resin, so that the toner particles can be uniformly charged, and the fine powder fraction and coarse powder fraction by-produced during toner production can be re-utilized, whereby effective toner production can be accomplished.

What is claimed is:

1. An image forming apparatus, comprising: an electrostatic image-bearing member for holding an electrostatic image thereon, and a developing apparatus for developing the electrostatic image; said developing apparatus including a developer container for storing a developer and a developer-carrying member for carrying thereon and conveying the developer from the developer container to a developing region confronting the electrostatic image-bearing member;

wherein said developer contains a toner comprising at least a binder resin and a charge control agent;

the binder resin having an acid value of 5–50;

the charge control agent comprising an iron complex represented by the following formula:

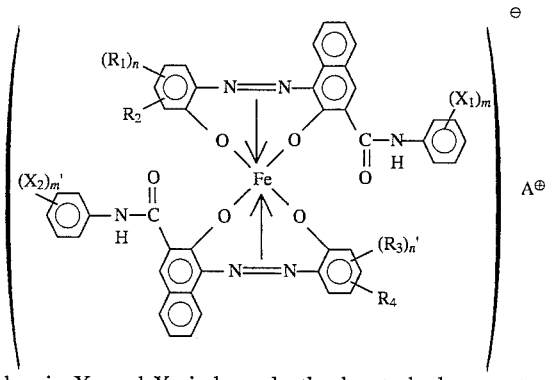

wherein $X_1$ and $X_2$ independently denote hydrogen atom, lower alkyl group, lower alkoxy group, nitro group or halogen atom; m and m' denote an integer of 1–3; $R_1$ and $R_3$ independently denote hydrogen atom, $C_{1-18}$ alkyl or alkenyl, sufonamide, mesyl, sulfonic acid group, carboxy ester group, hydroxy, $C_{1-18}$ alkoxy, acetylamino, benzoylamino or halogen atom; n and n' denote an integer of 1–3; $R_2$ and $R_4$ denote hydrogen atom or nitro group; and $A^{\oplus}$ denotes hydrogen ion, sodium ion, potassium ion or ammonium ion;

the toner having a weight-average particle size ($D_4$) of 4–9 μm and including toner particles having a particle size of 5 μm or smaller at 3–90% by number, toner particles having a particle size of 6.35–10.08 μm at 1–80% by number and toner particles having a particle size of 12.7 μm or larger at a percentage by volume of at most 2.0%, wherein the toner particles having a particle size of 5.0 μm or smaller are contained at N % by number and at V % by volume satisfying a relationship:

$$N/V=-0.05N+k,$$

wherein k is a positive number in the range of 3.0–7.5. 7.5.

2. The image forming apparatus according to claim 1, wherein the binder resin comprises a polyester resin.

3. The image forming apparatus according to claim 2, wherein the polyester resin has a glass transition point of 40°–90° C., a number-average molecular weight (Mn) of 1,500–50,000, and a weight-average molecular weight (Mw) of 10,000–5,000,000.

4. The image forming apparatus according to claim 3, wherein the polyester resin has a glass transition point of 45°–85° C., an Mn of 2,000–20,000 and an Mw of 15,000–3,000,000.

5. The image forming apparatus according to claim 2, wherein the polyester resin has an OH value of at most 50.

6. The image forming apparatus according to claim 5, wherein the polyester resin has an OH value of at most 30.

7. The image forming apparatus according to claim 1, wherein the binder resin comprises a vinyl copolymer.

8. The image forming apparatus according to claim 7, wherein the vinyl copolymer has a glass transition point of 40°–90° C., a number-average molecular weight (Mn) of 1,500–50,000, and a weight-average molecular weight (Mw) of 10,000–5,000,000.

9. The image forming apparatus according to claim 8, wherein the vinyl copolymer has a glass transition point of 45°–85° C., an Mn of 2,000–20,000 and an Mw of 15,000–3,000,000.

10. The image forming apparatus according to claim 7, wherein the vinyl copolymer has an OH value of at most 50.

11. The image forming apparatus according to claim 10, wherein the vinyl copolymer has an OH value of at most 30.

12. The image forming apparatus according to claim 1, wherein the binder resin has an acid value of 6–45.

13. The image forming apparatus according to claim 12, wherein the binder resin has an acid value of 7–40.

14. The image forming apparatus according to claim 1, wherein the binder resin comprises at least 50 wt. % of a resin having an acid value of 5–50.

15. The image forming apparatus according to claim 14, wherein the binder resin comprises at least 60 wt. % of the resin having an acid value of 5–50.

16. The image forming apparatus according to claim 1, wherein toner particles having a particle size of 5 μm or smaller are contained at 5–80% by number, toner particles having a particle size of 6.35–10.08 μm are contained at 5–70% by number, and toner particles having a particle size of 12.7 μm or larger are contained at at most 1.0% by volume.

17. The image forming apparatus according to claim 16, wherein toner particles having a particle size of 5 μm or smaller are contained at 9–75% by number, and toner particles having a particle size of 12.7 μm or larger are contained at most 0.5% by volume.

18. The image forming apparatus according to claim 1, wherein N satisfies $5 \leqq N \leqq 80$, and k satisfies $3.1 \leqq k \leqq 7.4$.

19. The image forming apparatus according to claim 18, wherein N satisfies $9 \leqq N \leqq 75$, and k satisfies $3.2 \leqq k \leqq 7.3$.

20. The image forming apparatus according to claim 1, wherein the iron complex is contained in a proportion of 0.1–10 wt. parts per 100 wt. parts of the binder resin.

21. The image forming apparatus according to claim 20, wherein the iron complex is contained in a proportion of 0.1–5 wt. parts per 100 wt. parts of the binder resin.

22. The image forming apparatus according to claim 1, wherein the iron complex comprises a compound selected from the group consisting of iron complexes (1)–(6) shown below:

Iron Complex (1)

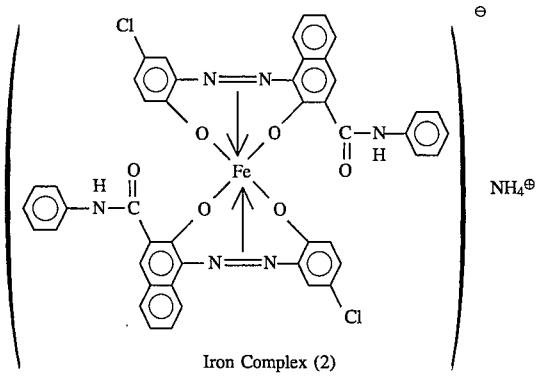

Iron Complex (2)

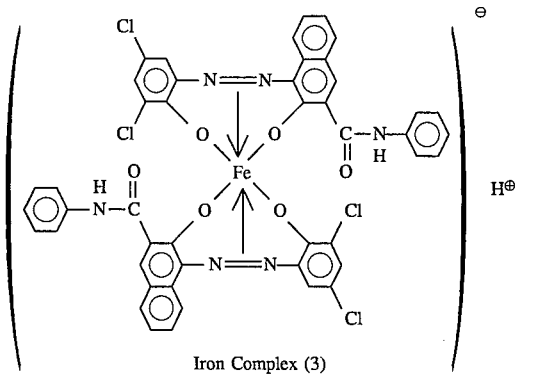

Iron Complex (3)

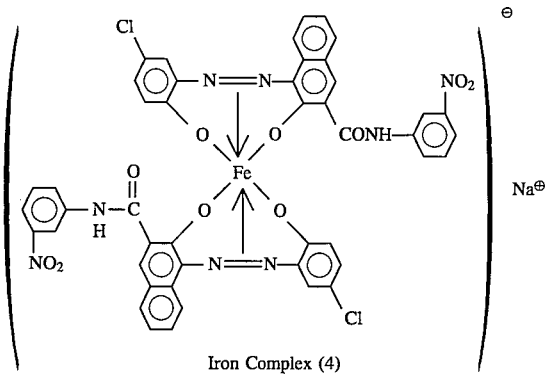

Iron Complex (4)

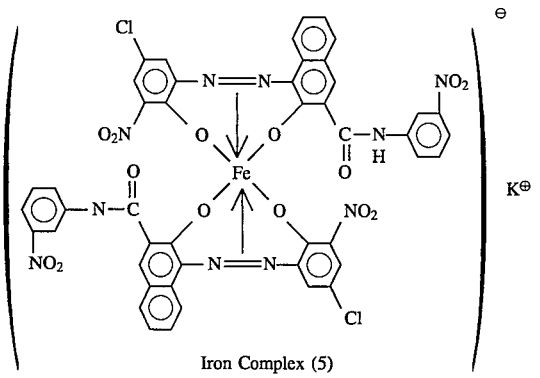

Iron Complex (5)

-continued

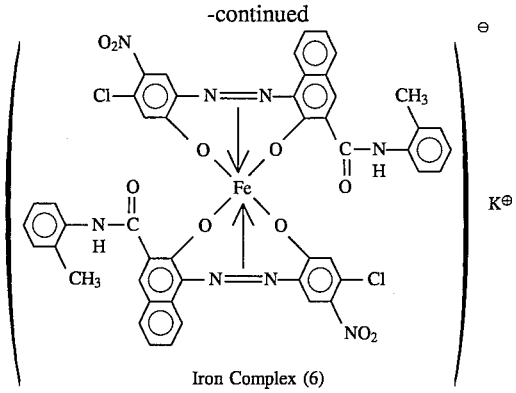

Iron Complex (6)

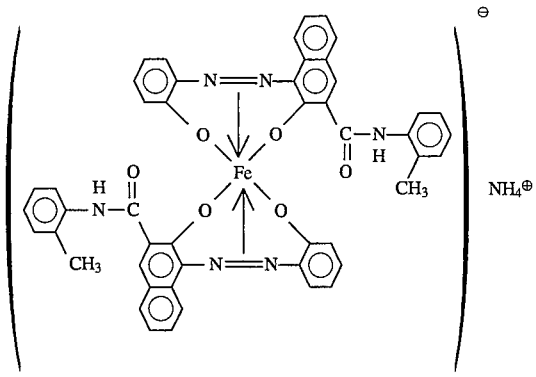

23. The image forming apparatus according to claim 1, further comprising a colorant.

24. The image forming apparatus according to claim 1, further comprising a magnetic material.

25. A process cartridge detachably mountable to a main assembly of an image forming apparatus, comprising an electrostatic image-bearing member and a developing means for developing the electrostatic image formed on the electrostatic image bearing member with a developer;

wherein said developer contains a toner comprising at least a binder resin and a charge control agent;

the binder resin having an acid value of 5–50;

the charge control agent comprising an iron complex represented by the following formula:

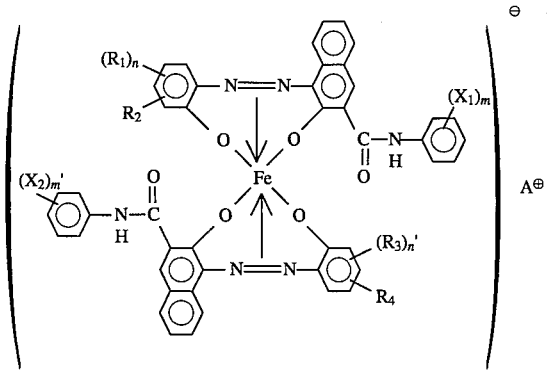

wherein $X_1$ and $X_2$ independently denote hydrogen atom, lower alkyl group, lower alkoxy group, nitro group or halogen atom; m and m' denote an integer of 1–3; $R_1$ and $R_3$ independently denote hydrogen atom, $C_{1-18}$ alkyl or alkenyl, sufonamide, mesyl, sulfonic acid group, carboxy ester group, hydroxy, $C_{1-18}$ alkoxy, acetylamino, benzoylamino or halogen atom; n and n' denote an integer of 1–3; $R_2$ and $R_4$ denote hydrogen atom or nitro group; and $A^+$ denotes hydrogen ion, sodium ion, potassium ion or ammonium ion;

the toner having a weight-average particle size ($D_4$) of 4–9 μm and including toner particles having a particle size of 5 μm or smaller at 3–90% by number, toner particles having a particle size of 6.35–10.08 μm at 1–80% by number and toner particles having a particle size of 12.7 μm or larger at a percentage by volume of at most 2.0%, wherein the toner particles having a particle size of 5.0 μm or smaller are contained at N % by number and at V % by volume satisfying a relationship:

$$N/V=-0.05N+k,$$

wherein k is a positive number in the range of 3.0–7.5.

26. The cartridge according to claim 25, wherein the binder resin comprises a polyester resin.

27. The cartridge according to claim 26, wherein the polyester resin has a glass transition point of 40°–90° C., a number-average molecular weight (Mn) of 1,500–50,000, and a weight-average molecular weight (Mw) of 10,000–5,000,000.

28. The cartridge according to claim 27, wherein the polyester resin has a glass transition point of 45°–85° C., an Mn of 2,000–20,000 and an Mw of 15,000–3,000,000.

29. The cartridge according to claim 26, wherein the polyester resin has an OH value of at most 50.

30. The cartridge according to claim 29, wherein the polyester resin has an OH value of at most 30.

31. The cartridge according to claim 25, wherein the binder resin comprises a vinyl copolymer.

32. The cartridge according to claim 31, wherein the vinyl copolymer has a glass transition point of 40°–90° C., a number-average molecular weight (Mn) of 1,500–50,000, and a weight-average molecular weight (Mw) of 10,000–5,000,000.

33. The cartridge according to claim 32, wherein the vinyl copolymer has a glass transition point of 45°–85° C., an Mn of 2,000–20,000 and an MW of 15,000–3,000,000.

34. The cartridge according to claim 31, wherein the vinyl copolymer has an OH value of at most 50.

35. The cartridge according to claim 34, wherein the vinyl copolymer has an OH value of at most 30.

36. The cartridge according to claim 25, wherein the binder resin has an acid value of 6–45.

37. The cartridge according to claim 36, wherein the binder resin has an acid value of 7–40.

38. The cartridge according to claim 25, wherein the binder resin comprises at least 50 wt. % of a resin having an acid value of 5–50.

39. The cartridge according to claim 38, wherein the binder resin comprises at least 60 wt. % of the resin having an acid value of 5–50.

40. The cartridge according to claim 25, wherein toner particles having a particle size of 5 μm or smaller are contained at 5–80% by number, toner particles having a particle size of 6.35–10.08 μm are contained at 5–70% by number, and toner particles having a particle size of 12.7 μm or larger are contained at most 1.0% by volume.

41. The cartridge according to claim 40, wherein toner particles having a particle size of 5 μm or smaller are contained at 9–75% by number, and toner particles having a particle size of 12.7 μm or larger are contained at most 0.5% by volume.

42. The cartridge according to claim 25, wherein N satisfies $5 \leqq N \leqq 80$, and k satisfies $3.1 \leqq k \leqq 7.4$.

43. The cartridge according to claim 42, wherein N satisfies $9 \leqq N \leqq 75$, and k satisfies $3.2 \leqq k \leqq 7.3$.

44. The cartridge according to claim 25, wherein the iron complex is contained in a proportion of 0.1–10 wt. parts per 100 wt. parts of the binder resin.

45. The cartridge according to claim 25, wherein the iron complex is contained in a proportion of 0.1–5 wt. parts per 100 wt. parts of the binder resin.

46. The cartridge according to claim 25, wherein the iron complex comprises a compound selected from the group consisting of iron complexes (1)–(6) shown below:

Iron Complex (1)

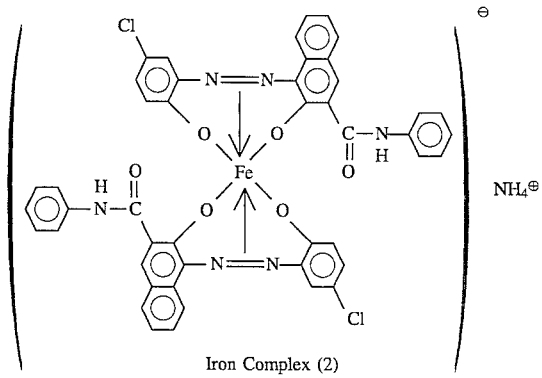

Iron Complex (2)

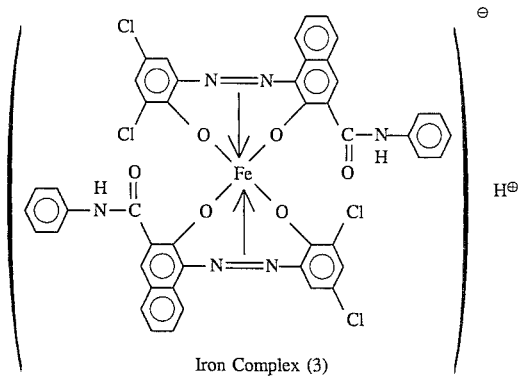

Iron Complex (3)

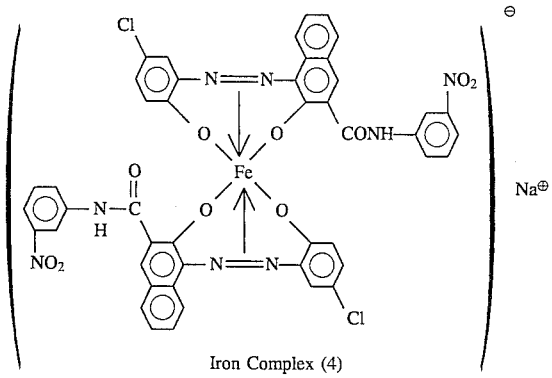

Iron Complex (4)

-continued
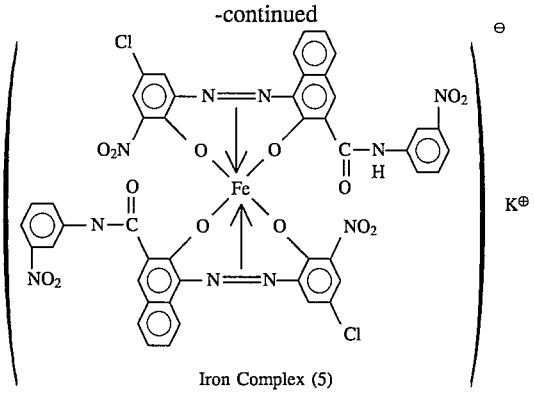
Iron Complex (5)
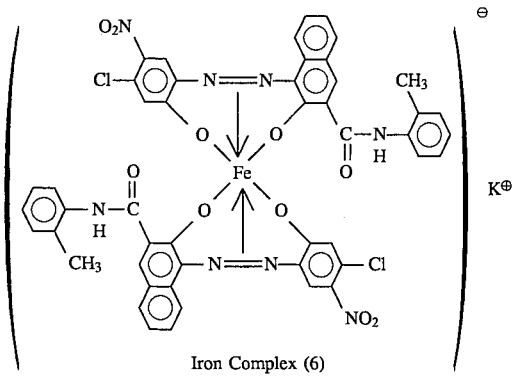
Iron Complex (6)
-continued
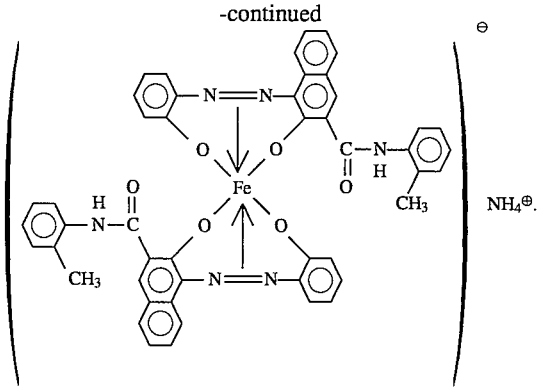
47. The cartridge according to claim 25, further comprising a colorant.
48. The cartridge according to claim 25, further comprising a magnetic material.
* * * * *

UNITED STATES PATENT AND TRADEMARK OFFICE

CERTIFICATE OF CORRECTION

PATENT NO. : 5,483,327

DATED : January 9, 1996

INVENTOR(S) : MASAAKI TAYA ET AL.

It is certified that error appears in the above-identified patent and that said Letters Patent is hereby corrected as shown below:

Title page,
AT [54] TITLE

"IMAGE," should read --IMAGE, IMAGE--.

COLUMN 1

Line 2, "IMAGE," should read --IMAGE, IMAGE--.

COLUMN 4

Line 57, "values," should read --value,--.

COLUMN 6

Line 18,"iraconic" should read --itaconic-.
Line 49, "metnacrylic" should read --methacrylic--.

COLUMN 14

Line 16, "ethylene-biscaprylamide," (first occurrence) should be deleted.
Line 18, "bisolerylamide," should read --bisoleylamide,--.

UNITED STATES PATENT AND TRADEMARK OFFICE

CERTIFICATE OF CORRECTION

PATENT NO. : 5,483,327

DATED : January 9, 1996

INVENTOR(S) : MASAAKI TAYA ET AL.

It is certified that error appears in the above-identified patent and that said Letters Patent is hereby corrected as shown below:

COLUMN 15

Line 26, "pyrolyric" should read --pyrolytic--.

COLUMN 16

Line 9, "Example" should read --Examples--.
Line 13, "benzyldimethylcholrosilane," should read --benzyldimethylchlorosilane,--.
Line 17, "vinyldimethylacetoxvsi-" should read --vinyldimethylacetoxysi- --.
Line 18, "dimethyldimethoxysihane," should read --dimethyldimethoxysilane,--.

COLUMN 17

Line 1, "traluforoethylene" should read --trafluoroethylene--.

COLUMN 18

Line 20, "nations" should read --nation--.
Line 45, "a" should read --to a--.

UNITED STATES PATENT AND TRADEMARK OFFICE

CERTIFICATE OF CORRECTION

PATENT NO. : 5,483,327

DATED : January 9, 1996

INVENTOR(S) : MASAAKI TAYA ET AL.

It is certified that error appears in the above-identified patent and that said Letters Patent is hereby corrected as shown below:

COLUMN 19

Line 19, "aC bias" should read --AC bias--.

COLUMN 20

Line 58, "introduce" should read --introducing--.

COLUMN 27

Line 61, "≤12.7" should read --≥12.7--.

COLUMN 28

Line 7, "practicality" should read --practically--.

COLUMN 28

Line 30, "$OD_M$=0,843." should read --$OD_M$=0.843.--.

COLUMN 30

Table 1, under N %/Vol. %, "of ≥5 μm" should read --of ≤5 μm--.

UNITED STATES PATENT AND TRADEMARK OFFICE

CERTIFICATE OF CORRECTION

PATENT NO. : 5,483,327

DATED : January 9, 1996

INVENTOR(S) : MASAAKI TAYA ET AL.

It is certified that error appears in the above-identified patent and that said Letters Patent is hereby corrected as shown below:

COLUMN 31

Table 1-continued, under N %/Vol. %, "of ≥5 μm" read --of ≤ 5μm--.
Table 2, Example 9, "1.34 ◯" should read --1.34 ⊙--.

COLUMN 34

Line 53, "at most" should read --at most at--.

COLUMN 37

Line 7, "$A^+$" should read --$A^{\oplus}$--.
Line 65, "at most" should read --at most at--.

UNITED STATES PATENT AND TRADEMARK OFFICE

CERTIFICATE OF CORRECTION

PATENT NO. : 5,483,327

DATED : January 9, 1996

INVENTOR(S) : MASAAKI TAYA ET AL.

It is certified that error appears in the above-identified patent and that said Letters Patent is hereby corrected as shown below:

COLUMN 38

Line 2, "at most" should read --at most at--.

Signed and Sealed this

Twenty-seventh Day of August, 1996

*Attest:*

*Attesting Officer*

BRUCE LEHMAN

*Commissioner of Patents and Trademarks*